US007645008B2

(12) United States Patent
Nagashima

(10) Patent No.: US 7,645,008 B2
(45) Date of Patent: Jan. 12, 2010

(54) PRESSURE SENSOR, PRESSURE MEASUREMENT APPARATUS, LIQUID EJECTION HEAD AND IMAGE FORMING APPARATUS

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 172 days.

(21) Appl. No.: 11/431,563

(22) Filed: May 11, 2006

(65) Prior Publication Data

US 2006/0256145 A1 Nov. 16, 2006

(30) Foreign Application Priority Data

May 13, 2005 (JP) ..... 2005-141304

(51) Int. Cl.
*B41J 29/38* (2006.01)

(52) U.S. Cl. ..... 347/12; 347/1; 347/5

(58) Field of Classification Search ..... 347/5, 347/9, 10, 68, 12, 1, 19; 73/704; 310/331
See application file for complete search history.

(56) References Cited

U.S. PATENT DOCUMENTS

| | | | | |
|---|---|---|---|---|
| 6,186,610 | B1 | 2/2001 | Kocher et al. | |
| 7,249,818 | B1 * | 7/2007 | Paasch | 347/19 |
| 2003/0081027 | A1 * | 5/2003 | Feinn et al. | 347/12 |
| 2005/0210988 | A1 * | 9/2005 | Amano et al. | 73/704 |

FOREIGN PATENT DOCUMENTS

JP 2000-94675 A 4/2000

* cited by examiner

*Primary Examiner*—Lam S Nguyen
(74) *Attorney, Agent, or Firm*—Birch, Stewart, Kolasch & Birch, LLP

(57) ABSTRACT

The pressure sensor is provided commonly with respect to a plurality of pressure measurement objects. The pressure sensor comprises: a piezoelectric body; and a first electrode and a second electrode which are disposed on either side of the piezoelectric body in a thickness direction, wherein at least one of the first electrode and the second electrode is formed so as to have a narrower width in coupling sections corresponding to positions between the pressure measurement objects, than a width of sections corresponding to the pressure measurement objects.

13 Claims, 17 Drawing Sheets

PRESSURE MEASUREMENT SIGNAL OF POSITIVE ELECTRODE (A)

PRESSURE MEASUREMENT SIGNAL OF NEGATIVE ELECTRODE (B)

SUBTRACTION (A-B)

PRESSURE SENSOR, PRESSURE MEASUREMENT APPARATUS, LIQUID EJECTION HEAD AND IMAGE FORMING APPARATUS

BACKGROUND OF THE INVENTION

1. Field of the Invention

The present invention relates to a pressure sensor, a pressure measurement apparatus, a liquid ejection head and an image forming apparatus, and more particularly, to a pressure sensor, a pressure measurement apparatus, a liquid ejection head, and an image forming apparatus suitable for high-density mounting.

2. Description of the Related Art

An image forming apparatus is known which forms images on a recording medium, such as paper, by ejecting ink from nozzles toward the recording medium, while moving a liquid ejection head (inkjet head) having an arrangement of a plurality of nozzles, and the recording medium, relatively with respect to each other.

A known liquid ejection head mounted in the image forming apparatus is, for example, a piezo type liquid ejection head, in which ink is supplied to pressure chambers connected to nozzles, and the volume of the pressure chambers is changed, thereby causing the ink inside the pressure chambers to be ejected from the nozzles, by applying a drive signal corresponding to the image data to piezoelectric bodies forming pressure generating devices which are installed via a diaphragm plate on the pressure chambers.

On the other hand, there are also known thermal jet liquid ejection heads, which generate bubbles by heating the ink by means of heaters, or other heating elements, and eject ink droplets by means of the pressure thus generated.

Furthermore, a liquid ejection head provided with a pressure sensor is also known.

For example, Japanese Patent Application Publication No. 2000-94675 (and in particular, FIGS. 2 and 13) discloses technology for providing pressure sensors which measure the internal pressure of the pressure chambers, and performing feedback control on the basis of the measurement results of these pressure sensors, with the object of suppressing inadvertent ejection of satellite ink droplets. The pressure sensors include a one-piece piezoelectric sensor wafer which is relatively thin and covers all of the pressure chambers arranged in a one-dimensional fashion, and a plurality of long and thin piezoelectric sensor strips provided respectively for the pressure chambers.

In recent years, there have been demands to form high-quality images by increasing the number of pixels (number of dots) per unit surface area, by arranging a plurality of nozzles at high density. If a plurality of nozzles are arranged at high density in order to meet these demands, then the plurality of pressure chambers connected respectively to these nozzles are also required to be arranged at high density.

On the other hand, in order to ensure high-quality images, there is also a requirement to provide accurate determination of ejection defectiveness, such as ink ejection failures, and if pressure sensors are disposed respectively at the pressure chambers in order to meet such requirements, then the number of wires also increases in accordance with the number of pressure chambers. However, it is difficult to lay such wires, which increase in number in accordance with the number of pressure chambers, in the gaps between pressure chambers which are arranged at high density.

For example, if the pitch of a plurality of pressure chambers arranged in a two-dimensional configuration is 0.5 mm in both the longitudinal direction and the lateral direction, and if the size of each pressure chamber is 0.3 mm in both the longitudinal direction and the lateral direction, then each of the gaps between the pressure chambers in which the wires can be laid has a width of 0.2 mm (=0.5 mm−0.3 mm). Here, it is assumed that the desired image resolution is 2400 dots per inch (dpi), and that it is sought to arrange 48 pressure chambers (≧0.5 mm/(25.4 mm/2400)) in the longitudinal direction in order to achieve this resolution. In this case, one pressure sensor wire is required for each pressure chamber, and even if the total of 48 wires are extended in two different directions (for example, the rightward direction and the leftward direction), and even subtracting one wire of one pressure chamber that does not need to pass between pressure chambers, it is still necessary to pass 23 (=48/2−1) wires through each of the gaps (having a width of 0.2 mm as described above) between the pressure chambers. In this case, the wiring pitch is 8.7 μm (=0.2 mm/23), and if approximately one half of this wiring pitch is the actual width of the wires, then wiring is very difficult to achieve in practice.

Japanese Patent Application Publication No. 2000-94675 discloses a relatively thin one-piece pressure sensor which covers all of the pressure chambers. If the pressure amplitudes, which are different in the pressure chambers, are to be measured, then it is difficult to use the one-piece pressure sensor covering all of the pressure chambers, and hence it is necessary to use pressure sensors provided respectively for the pressure chambers, and wires are required to be provided for the pressure chambers, as described above, in respect of the pressure sensors provided correspondingly at the pressure chambers. Furthermore, Japanese Patent Application Publication No. 2000-94675 discloses pressure chambers arranged in a one-dimensional fashion; however, it makes no mention of pressure chambers arranged in a two-dimensional configuration, and makes no mention of pressure sensors for measuring the pressure respectively in the pressure chambers two-dimensionally arranged, and of wiring for such pressure sensors. In other words, it is difficult to arrange pressure chambers at high density in a two-dimensional configuration, as well as to measure the pressure in the pressure chambers.

Furthermore, if the surface area of the pressure sensors increases, their electrostatic capacitance also increases, and their output voltage can fall.

SUMMARY OF THE INVENTION

The present invention has been contrived in view of these circumstances, an object thereof being to provide a pressure sensor having good pressure measurement sensitivity which allows the pressure measurement objects, such as pressure chambers that apply pressure to a liquid, to be arranged at high density, and a pressure measurement apparatus, a liquid ejection head and an image forming apparatus comprising such a pressure sensor.

In order to attain the aforementioned object, the present invention is directed to a pressure sensor which is provided commonly with respect to a plurality of pressure measurement objects, the pressure sensor comprising: a piezoelectric body; and a first electrode and a second electrode which are disposed on either side of the piezoelectric body in a thickness direction, wherein at least one of the first electrode and the second electrode is formed so as to have a narrower width in coupling sections corresponding to positions between the pressure measurement objects, than a width of sections corresponding to the pressure measurement objects.

According to this aspect of the present invention, it is only necessary to provide wiring connecting to a first electrode and wiring connecting to a second electrode, as the wiring for obtaining signals from a pressure sensor provided commonly with respect to a plurality of pressure measurement objects, and this is well suited to high-density arrangement of the pressure measurement objects. Furthermore, at least one of the electrodes is formed in such a manner that the width of the coupling sections corresponding to positions between the pressure measurement objects is narrower than the width of the sections corresponding to the pressure measurement objects, and therefore, the electrostatic capacitance of the coupling sections is reduced, and hence the output voltage is improved in comparison with a pressure sensor having electrodes of uniform width. Therefore, it is possible to provide a pressure sensor having better sensitivity.

Preferably, the coupling sections of the first electrode and the coupling sections of the second electrode are disposed at mutually different positions in a direction perpendicular to the thickness direction of the piezoelectric body, so as not to coincide in position with each other in the thickness direction of the piezoelectric body.

In order to attain the aforementioned object, the present invention is also directed to a pressure sensor which is provided commonly with respect to a plurality of pressure measurement objects, the pressure sensor comprising: a piezoelectric body; and a first electrode and a second electrode which are disposed on either side of the piezoelectric body in a thickness direction, each of the first electrode and the second electrode having sections corresponding to the pressure measurement objects and coupling sections corresponding to positions between the pressure measurement objects, wherein the coupling sections of the first electrode and the coupling sections of the second electrode are disposed at mutually different positions in a direction perpendicular to the thickness direction of the piezoelectric body, so as not to coincide in position with each other in the thickness direction of the piezoelectric body.

According to this aspect of the present invention, the coupling sections of the first electrode and the coupling sections of the second electrode are disposed in mutually different positions in the direction perpendicular to the thickness direction of the piezoelectric body, so as not to coincide in position with each other in the thickness direction of the piezoelectric body, and therefore, electrostatic capacitance in the coupling sections is reduced, and the output voltage is increased, and output of unwanted signal components caused by external effects can be prevented.

Preferably, in at least one of the first electrode and the second electrode, the coupling sections are disposed alternately in different positions in the direction perpendicular to the thickness direction of the piezoelectric body.

According to this aspect of the present invention, by disposing the coupling sections of the electrodes in alternating positions in terms of the direction perpendicular to the thickness direction of the piezoelectric body, then all of the coupling sections, which are the section that do not correspond to the pressure measurement objects, can receive uniform effects due to surplus noise, cross-talk, and the like, during pressure measurement, and hence the unwanted signal components caused by the effects of this noise, cross-talk, and the like, can be cancelled out readily.

In order to attain the aforementioned object, the present invention is also directed to a pressure measurement apparatus, comprising: the above-described pressure sensor; and a device which finds a difference between an output signal of the first electrode and an output signal of the second electrode.

According to this aspect of the present invention, the unwanted signal components due to the effects of noise, cross-talk, or the like, are cancelled out, and the pressure relating to the pressure measurement objects can be measured accurately, in isolation.

In order to attain the aforementioned object, the present invention is also directed to a liquid ejection head, comprising: a plurality of pressure chambers connected to ejection ports which eject liquid; and the above-described pressure sensor, which measures internal pressure of the pressure chambers, by taking the pressure chambers as the pressure measurement objects.

According to this aspect of the present invention, only wiring for connecting to the first electrode of the pressure sensor and wiring for connecting to the second electrode is required as wiring for obtaining a signal from a pressure sensor which is provided commonly for a plurality of pressure chambers, and therefore, it is possible to increase the density of arrangement of the pressure chambers, and to accurately determine the occurrence of ejection abnormalities by being able accurately to measure the internal pressure of the pressure chambers, by means of a pressure sensor of high sensitivity.

In order to attain the aforementioned object, the present invention is also directed to an image forming apparatus, comprising the above-described liquid ejection head, wherein an image is formed on a prescribed recording medium by ejecting ink from the liquid ejection head towards the recording medium.

According to this aspect of the present invention, since the internal pressure of the pressure chambers is measured by the aforementioned pressure sensor having good sensitivity provided in the liquid ejection head, then it is possible to carry out various processing in order to obtain a image of high quality, such as ejection abnormality determination processing, restoration processing, correction processing, and the like, on the basis of the internal pressures of the pressure chambers.

Preferably, the image forming apparatus further comprises a device for finding a difference between an output signal of the first electrode and an output signal of the second electrode.

According to this aspect of the present invention, the unwanted signal components due to the effects of noise, cross-talk, or the like, are cancelled out, and the pressure of the pressure chambers can be measured accurately, in isolation.

According to the present invention, it is possible to arrange the pressure measurement objects, such as pressure chambers, which apply pressure to a liquid, at a high density, and to improve the pressure measurement sensitivity.

BRIEF DESCRIPTION OF THE DRAWINGS

The nature of this invention, as well as other objects and advantages thereof, will be explained in the following with reference to the accompanying drawings, wherein.

DETAILED DESCRIPTION OF THE PREFERRED EMBODIMENTS

Structure of Liquid Ejection Head

Figure 1:
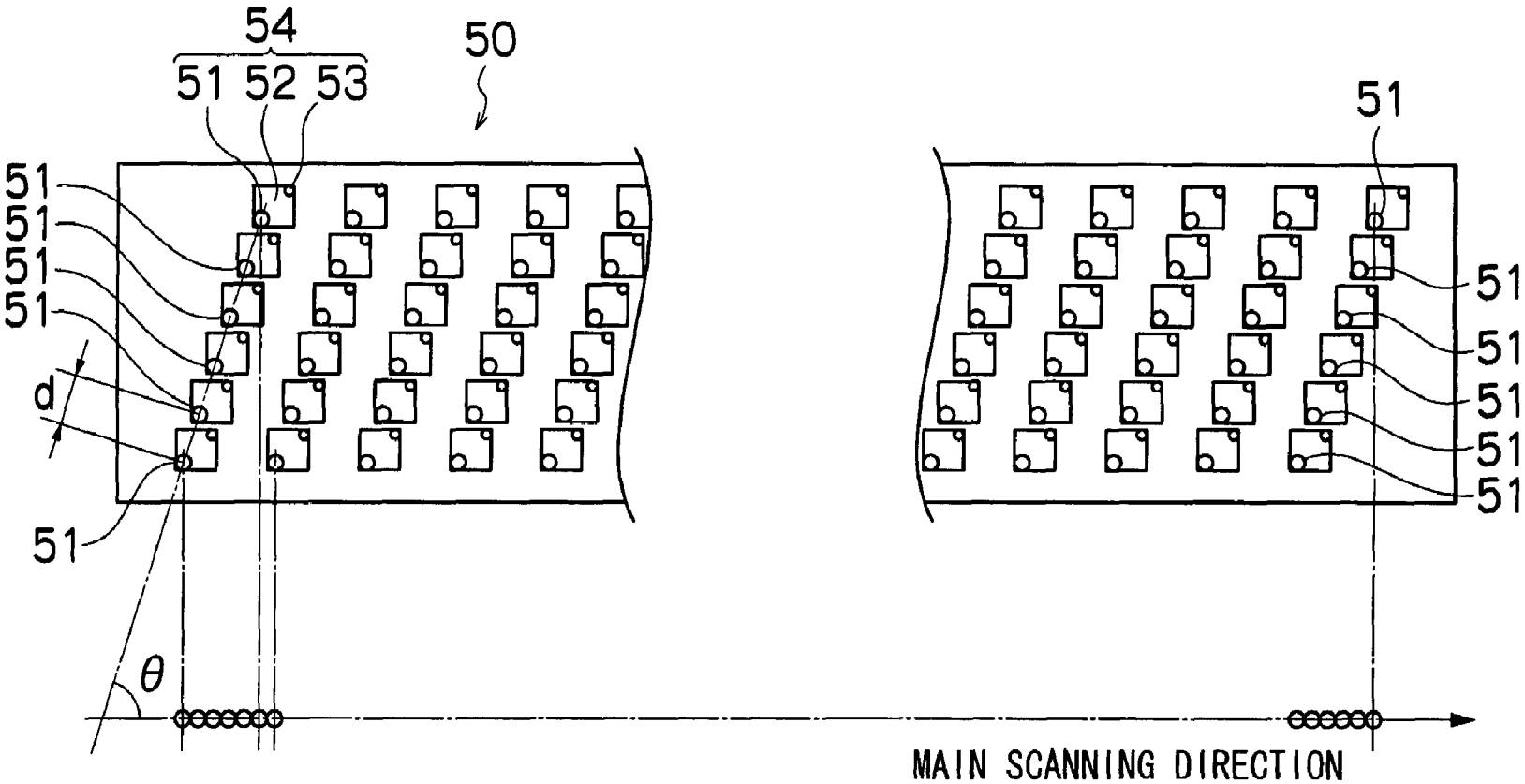
FIG. 1 is a plan view perspective diagram showing an approximate view of one example of the general structure of a liquid ejection head relating to an embodiment of the present invention.

FIG. 1 is a plan view perspective diagram showing an approximate view of one example of the general structure of a liquid ejection head according to an embodiment of the present invention.

In FIG. 1, the liquid ejection head 50 comprises a plurality of pressure chamber units 54 arranged in a two-dimensional configuration. Each pressure chamber unit 54 includes a nozzle 51 (ejection port) which ejects ink toward a recording medium, such as paper; a pressure chamber 52 being connected to the nozzle 51 and applying pressure to the ink in order to eject the ink from the nozzle 51; and an ink supply port 53 forming an opening section through which ink is supplied to the pressure chamber 52. In FIG. 1, in order to simplify the drawing, a portion of the pressure chamber units 54 is omitted from the drawing.

The plurality of nozzles 51 are arranged in the form of a two-dimensional matrix, in two directions: a main scanning direction (in the present embodiment, the direction substantially perpendicular to the conveyance direction of the recording medium); and an oblique direction forming a prescribed angle of θ with respect to the main scanning direction. More specifically, by arranging the plurality of nozzles 51 at a uniform pitch of d in the oblique direction forming the uniform angle of θ with respect to the main scanning direction, it is possible to treat the nozzles 51 as being equivalent to an arrangement of nozzles at a pitch P (=d×cos θ) in a straight line in the main scanning direction. Consequently, it is possible to achieve a composition which is substantially equivalent to a high-density nozzle arrangement which reaches 2400 nozzles per inch in the main scanning direction, for example. By means of this composition, an effective high density is achieved in the effective nozzle pitch (projected nozzle pitch) as projected to an alignment in the lengthwise direction of the liquid ejection head 50 (the main scanning direction). The nozzle arrangement in two directions as shown in FIG. 1 is called a two-dimensional matrix nozzle arrangement.

In other words, the plurality of nozzles 51 are arranged two-dimensionally in the liquid ejection head 50, and a plurality of pressure chambers 52 connected in a one-to-one correspondence with the nozzles 51 are also arranged two-dimensionally, in a similar fashion to the nozzles 51.

Figure 2:
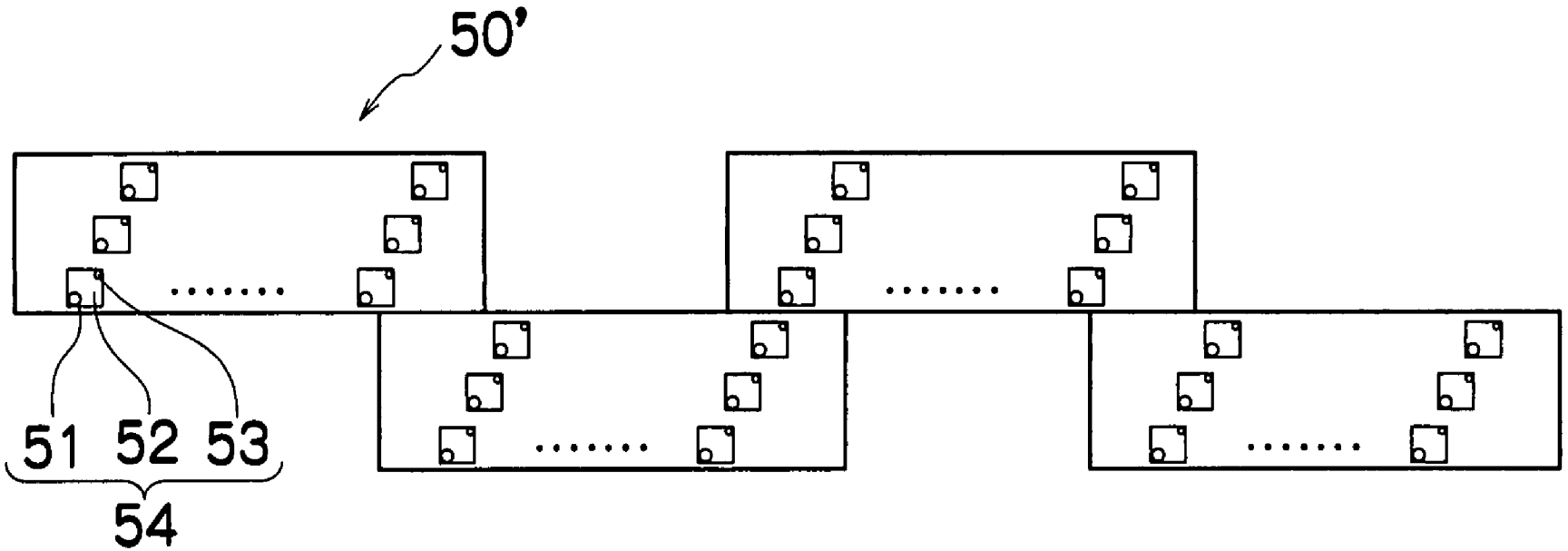
FIG. 2 is a plan view perspective diagram showing an approximate view of a further example of the general structure of a liquid ejection head relating to the embodiment.

In implementing the present embodiment, the arrangement structure of the nozzles 51, and the like, is not limited in particular to the example shown in FIG. 1. Furthermore, as shown in FIG. 2, it is also possible to compose a liquid ejection head having nozzle rows of a length corresponding to the full width of the recording medium, by joining together, in a staggered matrix arrangement, a number of short liquid ejection head blocks 50' in which a plurality of nozzles 51 are arranged two-dimensionally. The nozzle arrangement shown in FIG. 2 is also the two-dimensional matrix nozzle arrangement.

In either the case of the nozzle arrangement shown in FIG. 1, and the case of the nozzle arrangement shown in FIG. 2, it is possible to compose a full line type liquid ejection head comprising a row of nozzles covering a length corresponding to the full width of the recording medium in the main scanning direction (the direction substantially perpendicular to the conveyance direction of the recording medium).

Figure 3:
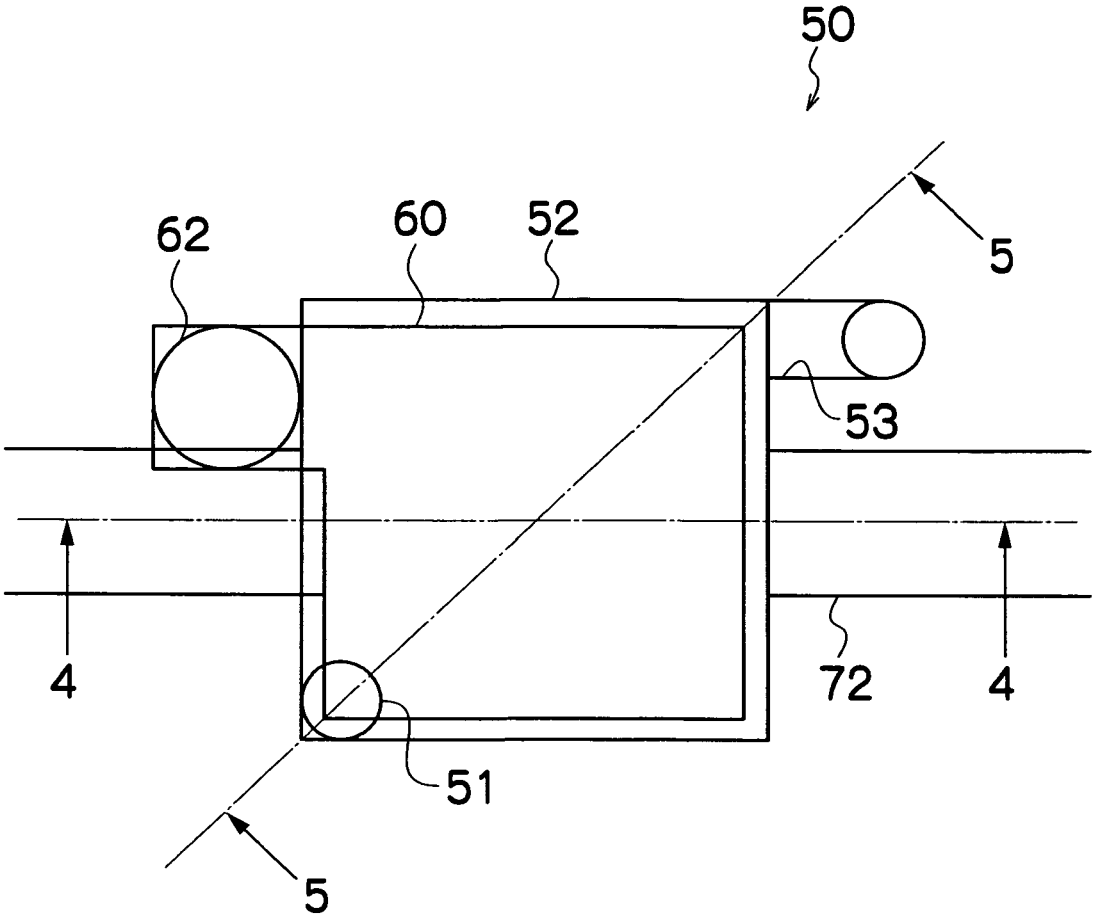
FIG. 3 is a plan view perspective diagram showing an enlarged view of a portion of the liquid ejection head shown in FIG. 1.
Figure 4:
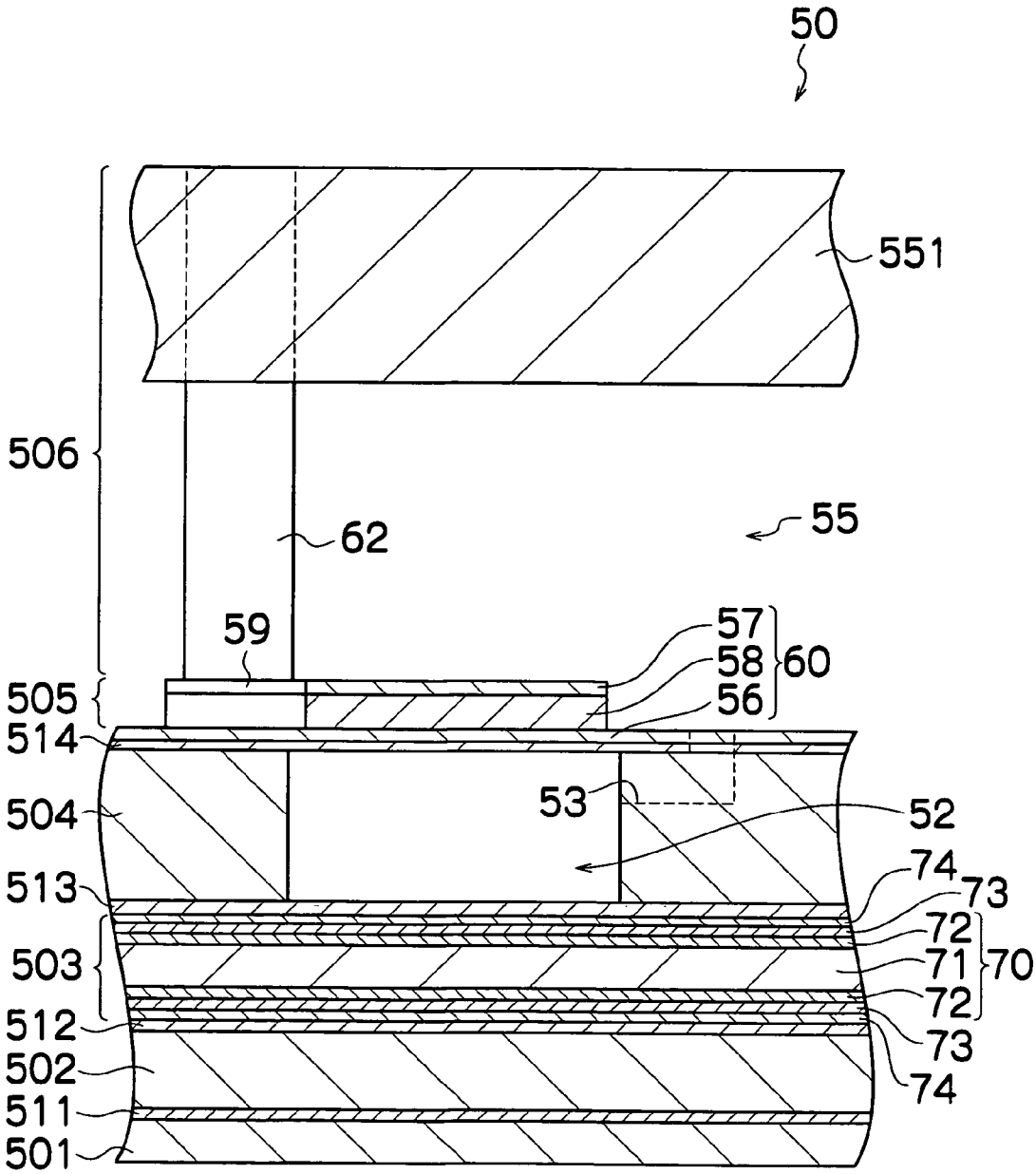
FIG. 4 is a cross-sectional diagram along line 4-4 in FIG. 3.
Figure 5:
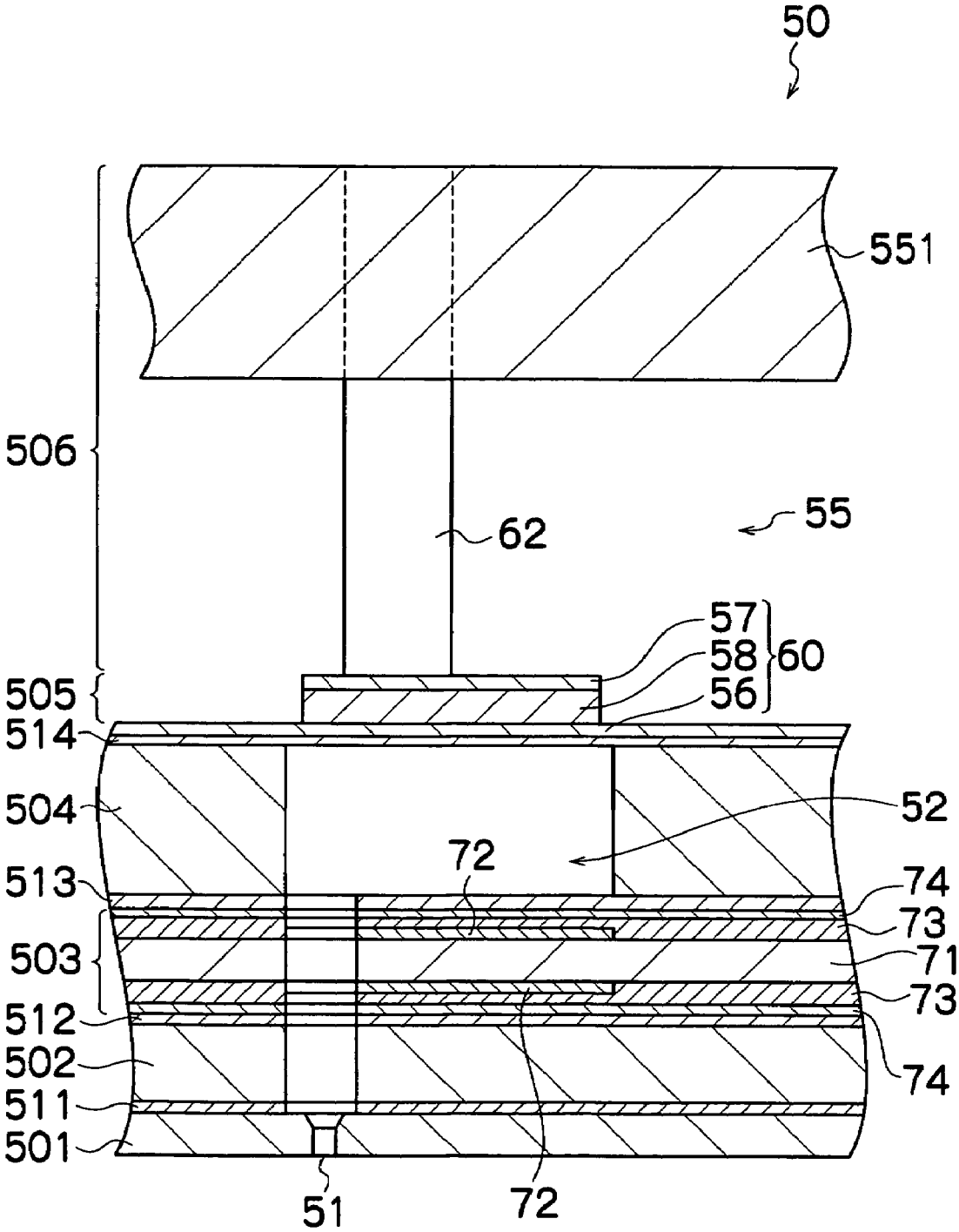
FIG. 5 is a cross-sectional diagram along line 5-5 in FIG. 3.

FIG. 3 is a plan view perspective diagram showing an enlarged view of a portion of the liquid ejection head 50 shown in FIG. 1. FIG. 4 shows a cross-sectional view along line 4-4 in FIG. 3. FIG. 5 shows a cross-sectional view along line 5-5 in FIG. 3.

As shown in FIGS. 4 and 5, the liquid ejection head 50 is formed by stacking a plurality of plates including a nozzle forming plate 501, a stainless steel plate 502, a pressure sensor forming plate 503, a pressure chamber forming plate 504, an actuator forming plate 505, and a common liquid chamber forming plate 506, with each other.

The nozzle forming plate 501 is formed with a plurality of nozzles 51 (ejection ports) which eject liquid. The stainless steel plate 502 is made of stainless steel which is bonded to the nozzle forming plate 501 through a bonding layer (first bonding layer) 511. The pressure sensor forming plate 503 is formed with one or a plurality of pressure sensors 70.

The pressure sensor 70 is constituted by sandwiching a piezoelectric body layer 71 for pressure measurement (hereinafter, also referred to simply as "pressure measurement piezoelectric body") made of a piezoelectric material, such as PVDF (polyvinylidene fluoride), between electrode layers 72 (hereinafter, also referred to simply as "electrodes") made of a conductive material, such as metal.

The pressure measurement piezoelectric body 71 according to the present embodiment is formed of one plate which is common for a plurality of pressure chambers 52, but it is not limited to a case of this kind, and may also be formed separately for each pressure chamber 52.

Here, an example is illustrated in which the electrodes 72 of the pressure sensor 70 extend in the direction of the line 4-4 in FIG. 3 (in other words, the main scanning direction), and these electrodes 72 are formed as common elements for a plurality of pressure chambers 52. However, the invention is not limited in particular to this case. For example, there is also a case in which the electrodes extend in an oblique direction forming a prescribed angle with respect to the main scanning direction.

The change in the internal pressure of the pressure chambers 52 formed in the pressure chamber forming plate 504, which is described below, causes distortion of the pressure measurement piezoelectric body 71. The distortion of the piezoelectric body 71 produces electric charge, and a voltage (hereinafter, called "pressure measurement signal") corresponding to the internal pressure of the pressure chambers 52 is thereby induced between the electrodes 72 of the pressure sensor 70.

Furthermore, shield layers 74 are arranged on both surfaces (the upper side and lower side) of the pressure sensor 70 across insulating layers 73. The shield layers 74 are earthed, and they shield the pressure sensor 70 from external electric fields.

In other words, the electrode 72, the insulating layer 73 and the shield layer 74 are arranged in this order on each of the upper side and the lower side of the pressure measurement piezoelectric body 71, and the piezoelectric body 71 is thereby sandwiched between them. The pressure sensor forming plate 503 is constituted by the piezoelectric body 71, the electrodes 72, the insulating layers 73 and the shield layers 74. The pressure sensor forming plate 503 is bonded to the stainless steel plate 502 through an insulating bonding layer (second bonding layer) 512.

The pressure chamber forming plate 504 is formed with the plurality of pressure chambers 52 connected respectively to the nozzles 51. The pressure chamber forming plate 504 is bonded to the pressure sensor forming plate 503 through an insulating bonding layer (third bonding layer) 513.

The actuator forming plate 505 is formed with a plurality of actuators 60 corresponding respectively to the pressure chambers 52, and the actuators 60 serve as pressure generating devices, which change the volume of the pressure chambers 52. The actuator forming plate 505 is bonded to the pressure chamber forming plate 504 through an insulating bonding layer (fourth bonding layer) 514.

The actuators 60 are constituted by disposing a diaphragm 56 having conductive properties and an individual electrode 57 on either side of a piezoelectric body 58 for pressure generation (hereinafter, also referred to simply as "pressure generation piezoelectric body") made of a piezoelectric material, such as PZT (lead zirconate titanate) (i.e., the diaphragm 56 is disposed on one side of the pressure generation piezoelectric body 58, and the individual electrode 57 is disposed on the other side).

The diaphragm 56 is arranged at the side of the pressure chamber forming plate 504 reverse to the side where the nozzle forming plate 501, the stainless steel plate 502, and the pressure sensor forming plate 503 are arranged, and the diaphragm 56 constitutes one face (vibrating face) of the pressure chamber 52.

Furthermore, the diaphragm 56 is earthed, and constitutes one electrode (the common electrode) of the actuators 60. The other electrode of each actuator 60 is constituted by the individual electrode 57, and an electrode pad 59 for a drive signal is formed extending from the individual electrode 57. The drive signal electrode pad 59 is connected externally via a column-shaped electrical wire 62, which is described hereinafter.

The pressure generation piezoelectric body 58 generates distortion when a prescribed drive signal is supplied to the individual electrode 57, thereby causing the volume of the pressure chamber 52 to change through the diaphragm 56.

The diaphragm 56 according to the present embodiment is formed of one plate that is common for a plurality of pressure chambers 52, but it is not limited to a case of this kind, and a diaphragm may also be formed separately for each pressure chamber 52.

The common liquid chamber forming plate 506 is arranged over the actuator forming plate 505, on the side reverse to the side where the pressure chamber forming plate 504 is arranged. The common liquid chamber forming plate 506 is formed with a common liquid chamber 55 for supplying ink to the pressure chambers 52, and the column-shaped electrical wires 62 for supplying drive signals to the actuators 60.

FIGS. 4 and 5 show only a portion of the liquid ejection head 50 in FIG. 1 that corresponds to one pressure chamber unit 54, and therefore, only the ceiling plate 551 is depicted, of the walls defining the common liquid chamber 55. However, in practice, there are also side walls, which are not shown in FIGS. 4 and 5.

The common liquid chamber 55 is formed as a flow channel creating a single common space which covers all of the plurality of pressure chambers 52, directly above the plurality of pressure chambers 52, when the pressure chambers 52 are viewed with the nozzles 51 oriented toward the bottom. Ink is supplied from an ink tank forming an ink storage device (not shown) to the plurality of pressure chambers 52 by means of the ink supply ports 53. By means of the common liquid chamber 55, the ink is supplied to each pressure chamber 52 with good refill efficiency.

The column-shaped electrical wires 62 rise up in a substantially vertical direction with respect to the surface on which the actuators 60 are disposed. The column-shaped electrical wires 62 pass through the common liquid chamber 55 and reach the ceiling plate 551 of the upper surface of the common liquid chamber 55. A flexible printed circuit (FPC) (not shown) is provided on the upper surface of the ceiling plate 551, and prescribed drive signals are supplied through the FPC to the column-shaped electrical wires 62 from outside the liquid ejection head 50.

Figure 6:
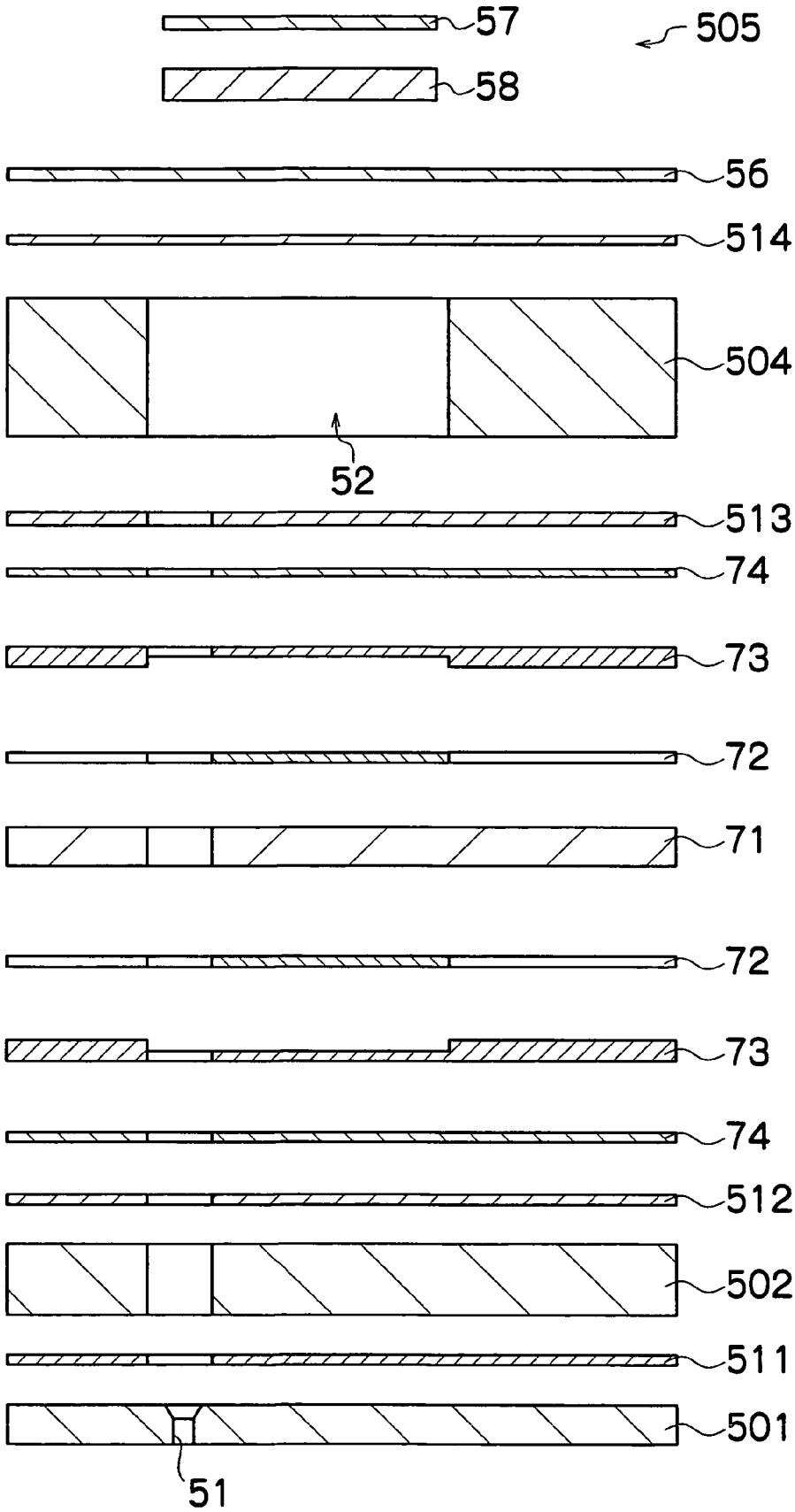
FIG. 6 is an exploded cross-sectional diagram showing an enlarged view of the representative parts of the liquid ejection head shown in FIG. 5.

FIG. 6 shows the constituent elements of the liquid ejection head 50 shown in the cross-sectional view in FIG. 5, from the nozzle forming plate 501 to the actuator forming plate 505.

Looking at examples of the thickness of the main constituent elements, the nozzle plate 501 is 50 μm thick, the first bonding layer 511 is 2 μm, the stainless steel plate 502 is 80 μm, the second bonding layer 512 and the third bonding layer 513 each are 5 μm, the shield layer 74 is 1 μm, the insulating layer 73 is 5 μm (namely, the thickness of the section which is adjacent to the electrode 72), the electrode 72 is 1 μm, the pressure measurement piezoelectric body 71 is 40 μm, the pressure chamber forming plate 504 is 150 μm, and the diaphragm 56 is 5 μm.

FIGS. 3 to 6 only show a portion of the liquid ejection head 50 in FIG. 1 that corresponds to one pressure chamber unit 54, and therefore, only one combination of the nozzle 51, pressure chamber 52 and actuator 60 is depicted. However, in actual practice, needless to say, a plurality of combinations of these elements are formed in one liquid ejection head 50.

Structure of Pressure Sensor

Figure 7:
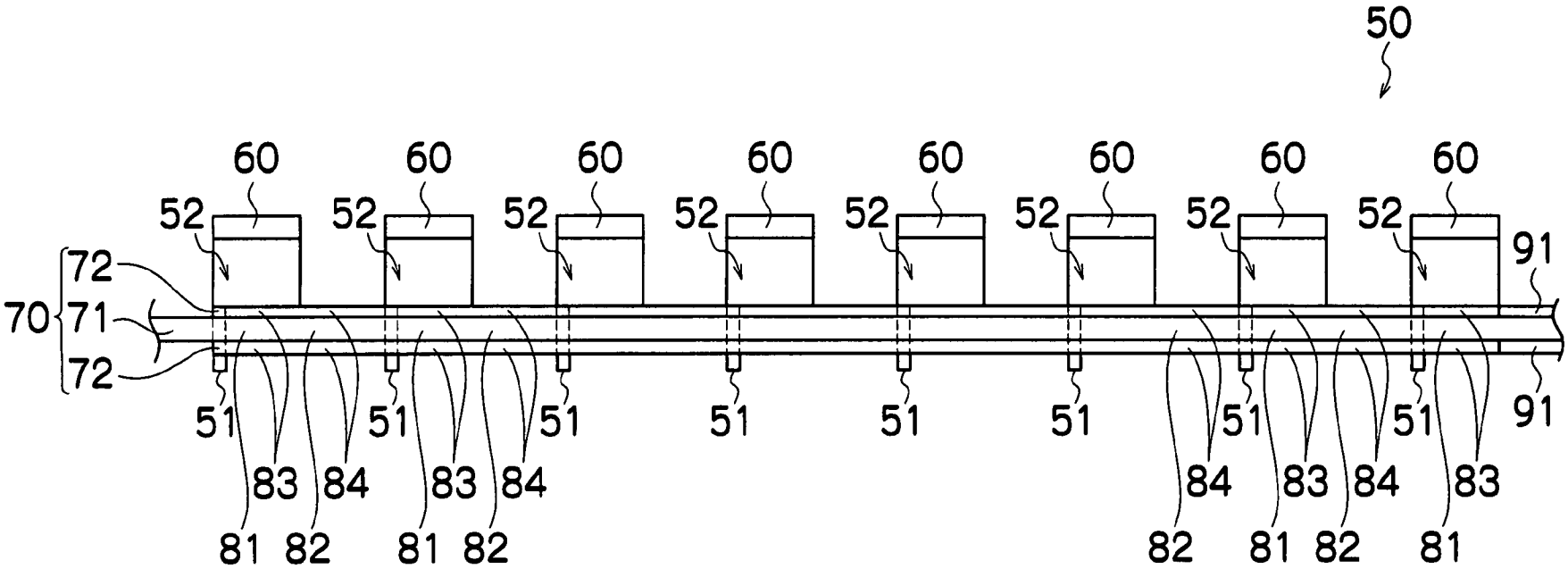
FIG. 7 is a schematic drawing used to describe the basic structure of a pressure sensor.

FIG. 7 is a cross-sectional diagram showing a schematic example of the positional relationships between the pressure sensor 70, the actuators 60 forming the pressure generating devices, the pressure chambers 52 which are the object of pressure measurement by the pressure sensor 70, and the nozzles 51 which eject the liquid inside the pressure chambers 52 due to the pressure generated by the actuators 60. The other constituent elements shown in FIGS. 3 to 6 (the constituent elements of the liquid ejection head 50 other than the pressure sensor 70, the actuators 60, the pressure chambers 52 and the nozzles 51) are omitted from FIG. 7 in order to simplify the description.

The pressure sensor 70 is provided commonly with respect to a plurality of pressure chambers 52 that are the object of pressure measurement. For example, as shown in FIG. 7, eight pressure chambers 52 are taken as one group, and one common pressure sensor 70 is provided which outputs a voltage corresponding to the internal pressure in these eight pressure chambers 52.

There is no particular restriction on the number of pressure chambers 52 corresponding to one pressure sensor 70.

The pressure sensor 70 is disposed so as to cover the plurality of pressure chambers 52 that are to be subject to pressure measurement by the pressure sensor 70. For example, as shown in FIG. 7, the pressure sensor 70 is disposed so as to cover the eight pressure chambers 52, on the lower side of the eight pressure chambers 52 forming one group (the side where the nozzles 51 are located).

The position where the pressure sensor 70 is disposed is not limited to being a position below the pressure chambers 52, which are the object of pressure measurement. For instance, it is also possible to dispose a pressure sensor 70 perpendicularly with respect to the surface on which the nozzles 51 are located, on the side faces of the plurality of pressure chambers 52 forming one group. However, in order to arrange the pressure chambers 52 two-dimensionally at high density, it is more desirable to dispose the pressure sensor 70 below the pressure chambers 52, rather than disposing the pressure sensor 70 on the side faces of the pressure chambers 52. Furthermore, in order to achieve accurate determination of the ejection states of the nozzles 51, desirably, the pressure sensor 70 is disposed in the vicinity of the nozzles 51, as shown in FIG. 7.

The pressure sensor 70 shown as one example in FIG. 7 comprises the flat plate-shaped piezoelectric body 71 provided commonly with respect to all of the pressure chambers 52 in the liquid ejection head 50, and a pair of electrodes 72 (a positive electrode and a negative electrode) provided commonly with respect to each group of eight pressure chambers 52. Furthermore, wires 91 (the wires denoted with reference numerals 91-1, 91-2, 91-3 in FIG. 10) are extended from the positive and negative electrodes 72, in the lengthwise direction of the electrodes 72.

The pressure measurement piezoelectric body 71 is not limited to a case where it is common with respect to all of the pressure chambers 52, and it may also be physically divided. For example, it is also possible to take a plurality of pressure chambers 52 (for example, eight pressure chambers) as one group, similarly to the electrodes 72, and to provide each of a plurality of piezoelectric bodies 71 commonly with respect to each of groups of the pressure chambers 52, or furthermore, the piezoelectric bodies may also be provided individually with respect to the pressure chambers 52.

Furthermore, the shape of the pressure measurement piezoelectric body 71 is not limited to being the flat plate shape. However, if a pressure sensor 70 is provided between the pressure chambers 52 and the nozzles 51, then desirably, the distance from the pressure chambers 52 to the ejection surface of the nozzles 51 is shortened, by using a piezoelectric material of a thin plate as a piezoelectric body 71, in such a manner that the ejection response with respect to the pressure generated by the actuator 60 does not decline.

The pressure measurement piezoelectric body 71 is made of a piezoelectric material having ferroelectric properties (dielectric properties), such as PVDF, or the like.

Furthermore, the pressure measurement piezoelectric body 71 shown in FIG. 7 includes sections 81 (measurement correspondence sections) corresponding to the pressure chambers 52 that are the object of pressure measurement, and sections 82 (measurement non-correspondence sections) corresponding to the positions between the pressure chambers 52. However, if the pressure measurement piezoelectric body 71 is provided in a physically divided fashion for each pressure chamber 52, then the measurement non-correspondence sections 82 of the piezoelectric body 71 do not exist.

The pair of electrodes 72 on either side of the pressure measurement piezoelectric body 71 are formed by two thin plates (or thin films) made of conductive material, such as metal. These electrodes 72 include sections 83 (measurement correspondence sections) corresponding to the pressure chambers 52 that are the object of pressure measurement, and coupling sections 84 (measurement non-correspondence sections) corresponding to the positions between the pressure chambers 52.

Each of the measurement correspondence sections 83 of the electrodes 72 shown as an example in FIG. 7 has substantially the same surface area as the cross-sectional area of each pressure chamber 52, and when distortion occurs in the piezoelectric body 71 in accordance with the internal pressure of the pressure chamber 52, an electric charge corresponding to this distortion is induced with good efficiency.

The surface area of the measurement correspondence sections 83 of the electrodes 72 is not limited in particular to being equal to the cross-sectional area of the pressure chambers 52 which are the object of pressure measurement. For example, it is also possible to provide measurement correspondence sections 83 that correspond only to the peripheral sections of the nozzles 51, of the pressure chambers 52.

An electric charge is also induced in the coupling sections 84 (measurement non-correspondence sections) of the electrodes 72, but the amount of the electric charge of the coupling sections 84 is small compared to the amount of electric charge induced in the measurement correspondence sections 83 of the electrodes 72.

Various different modes are possible for the specific mode of the pressure sensor 70 in which the effects of the electric charge induced in the coupling sections 84 of the electrodes 72 are reduced to a negligible level, and therefore, representative examples of these are described in detail below, in a first embodiment to a fifth embodiment.

Firstly, the pressure sensor according to the first embodiment is described with reference to FIGS. 8 to 11 below.

Figure 8:
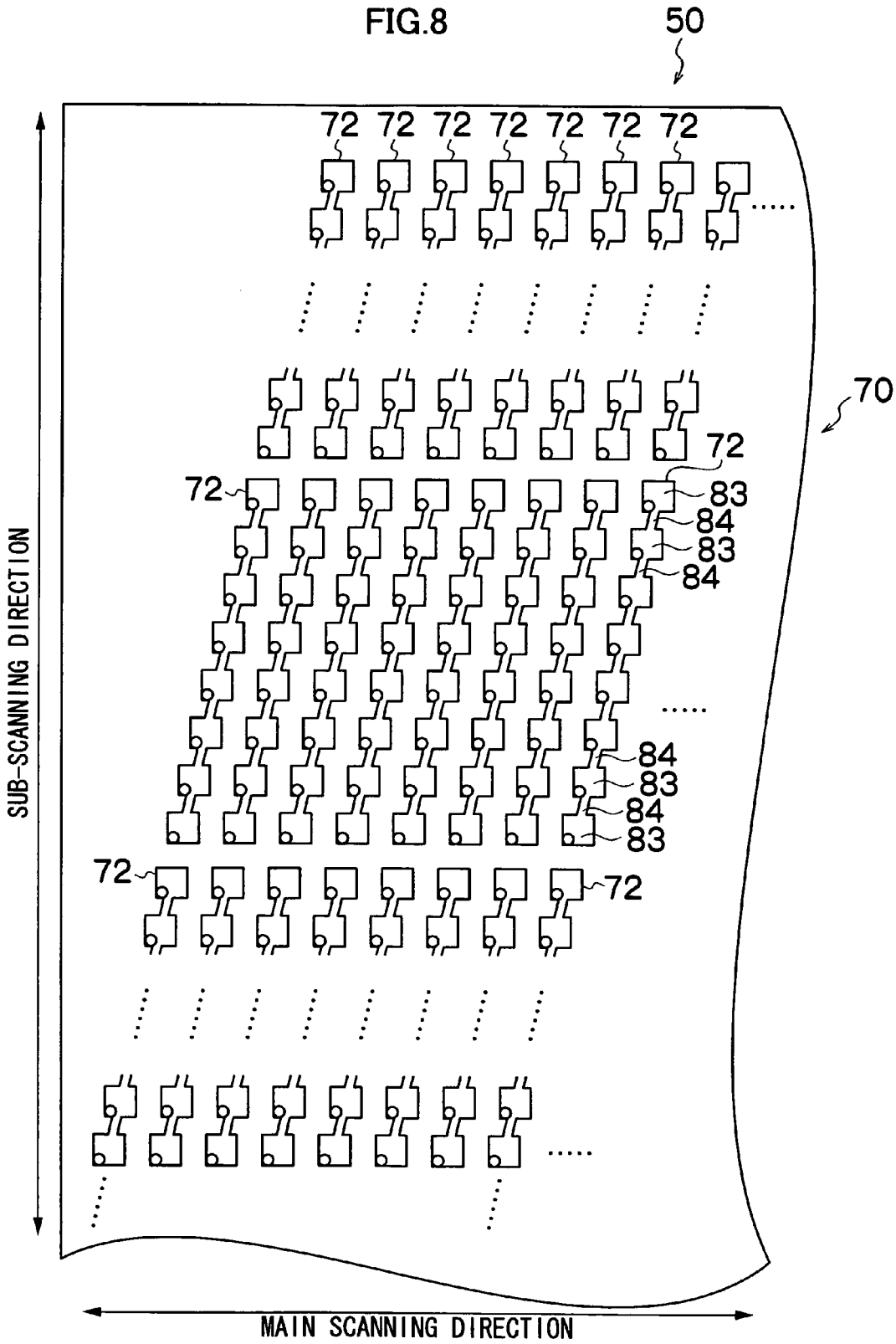
FIG. 8 is a plan view perspective diagram showing a schematic view of a liquid ejection head in which pressure sensors are arranged in an oblique direction with respect to the main scanning direction.
Figure 9:
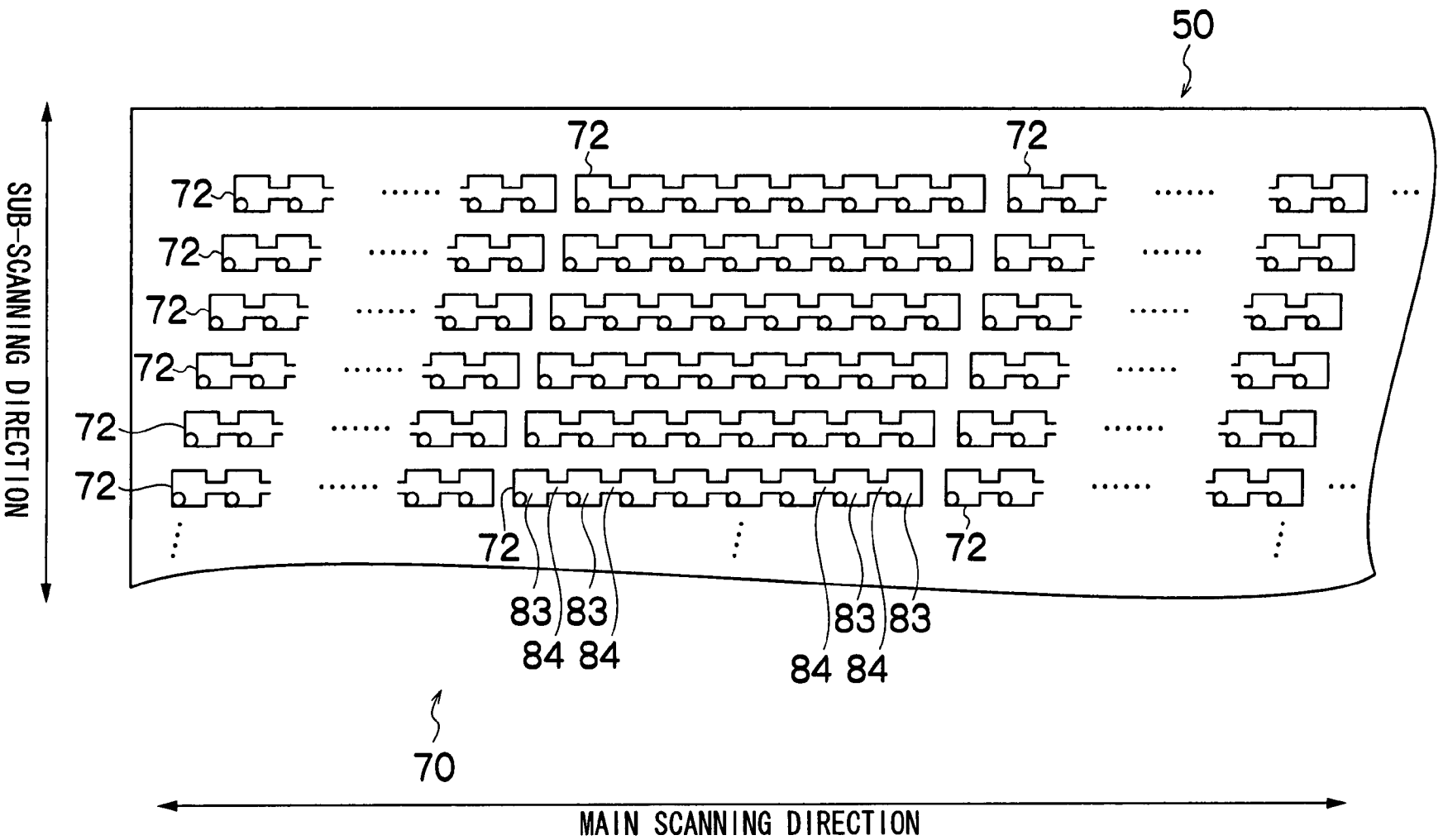
FIG. 9 is a plan view perspective diagram showing a schematic view of a liquid ejection head in which pressure sensors are arranged in the main scanning direction.

FIG. 8 is a plan view perspective diagram showing an ink ejection head 50 in a case where each pressure sensor 70 according to the first embodiment is disposed in an oblique direction with respect to the main scanning direction. FIG. 9 is a plan view perspective diagram showing an ink ejection head 50 in a case where each pressure sensor 70 according to the first embodiment is disposed in the main scanning direction.

Figure 10:
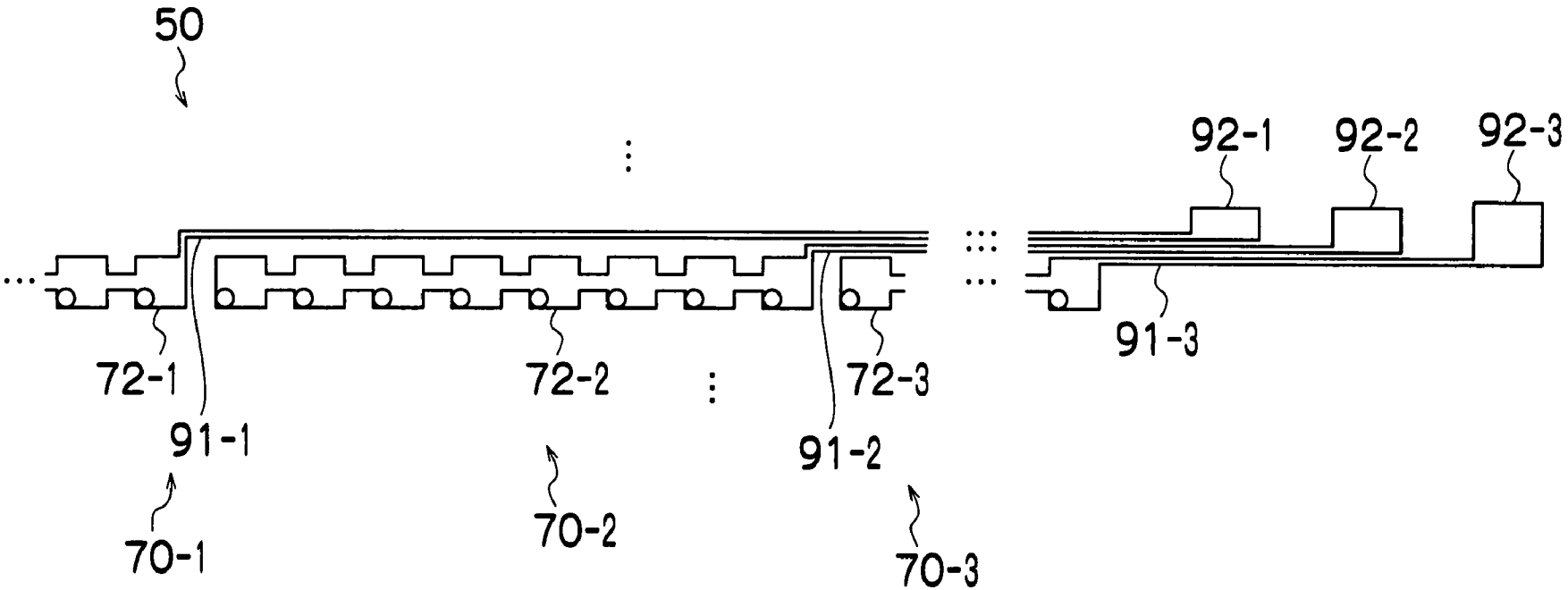
FIG. 10 is a plan diagram showing one portion of the wiring to pressure sensors.

FIGS. 8 and 9 show only the electrodes 72 of the pressure sensors 70, and in order to simplify the description, they do not show the other constituent elements shown in FIG. 1 (e.g., the nozzles 51, pressure chambers 52 and ink supply ports 53), the pressure measurement piezoelectric body 71, or the wires 91 from the electrodes 72 (the wires denoted with reference numerals 91-1, 91-2, 91-3 in FIG. 10).

As shown in FIGS. 8 and 9, each pressure sensor 70 according to the first embodiment is formed in such a manner that the width of the coupling sections 84 corresponding to the positions between the pressure chambers 52 is narrower than the width of the measurement correspondence sections 83 corresponding to the positions of the pressure chambers 52.

In the examples shown in FIGS. 8 and 9, the measurement correspondence sections 83 are formed with the same shape as the cross-sectional shape of the pressure chambers 52, and have a surface area that is equivalent to the cross-sectional area of the pressure chambers 52, but the shape and the cross-sectional area of the measurement correspondence sections 83 are not limited to these.

Desirably, the narrower the width of the coupling sections 84, the better, since this allows the electrostatic capacitance of the coupling sections 84 to be lowered, provided that the wiring resistance of the coupling sections 84 does not increase excessively, and provided that there are no disconnection problems, or the like. The width of the coupling sections 84 can be ⅓ or less of the width of the pressure chambers 52 (i.e., ⅓ or less of the width of the measurement correspondence sections 83 of the electrodes 72), for example.

Examples of the arrangement of each pressure sensor 70 are not limited in particular to the examples shown in FIGS. 8 and 9. FIGS. 8 and 9 each show a case where the pressure sensors 70 according to the present embodiment are used in the liquid ejection head 50 in which pressure chambers 52 such as that shown in FIG. 1 are arranged in a two-dimensional matrix in the main scanning direction and an oblique direction, and needless to say, the arrangement of each pressure sensor 70 is altered in accordance with the mode of arrangement of the pressure chambers 52 which are the object of pressure measurement. For example, if the pressure chambers 52 are arranged in the sub-scanning direction, then each pressure sensor 70 may also be disposed in the sub-scanning direction. Furthermore, if the pressure chambers 52 are arranged one-dimensionally, then needless to say, each pressure sensor 70 may also be arranged one-dimensionally.

FIG. 10 shows a plan diagram of one portion of the wiring to the pressure sensors 70 in a case where the pressure sensors 70 are arranged in the main scanning direction as shown in FIG. 9.

In FIG. 10, pressure measurement signal wires 91 (91-1, 91-2, 91-3) are formed from the electrodes 72 (72-1, 72-2, 72-3) of the pressure sensors 70 (70-1, 70-2, 70-3) arranged in one direction, to electrode pads 92 (92-1, 92-2, 92-3) for outputting pressure measurement signals to the exterior of the liquid ejection head 50.

In actual practice, the pairs of electrodes 72 (positive and negative electrodes) are formed on either side of the piezoelectric body 71 as shown in FIG. 7, and therefore, the pressure measurement signal wires 91 and the electrode pads 92 shown in FIG. 10 are provided separately for the positive electrodes and the negative electrodes, on either side of the piezoelectric body 71 (the upper side and the lower side of the piezoelectric body 71 in FIG. 7).

Figure 11:
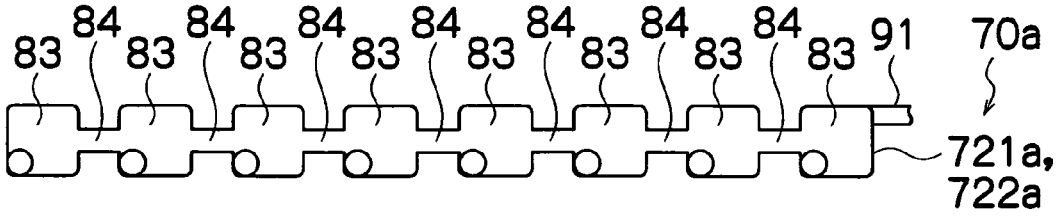
FIG. 11 is a plan diagram showing a pressure sensor according to a first embodiment.

FIG. 11 is a plan diagram showing one pressure sensor according to the first embodiment. In order to distinguish this from the pressure sensors according to other embodiments described below, in FIG. 11, reference numeral 70*a* is assigned to the pressure sensor of the first embodiment, and reference numeral 721*a* is assigned to the positive electrode of the pressure sensor 70*a*, while reference numeral 722*a* is assigned to the negative electrode of the pressure sensor 70*a*. In the pressure sensor 70*a* according to the first embodiment, the positive electrode 721*a* and the negative electrode 722*a* have the same shape.

Furthermore, in FIG. 11, the pressure measurement piezoelectric body 71 is taken to be provided commonly for all of the pressure chambers 52, and it is omitted from the drawing.

Figure 12:
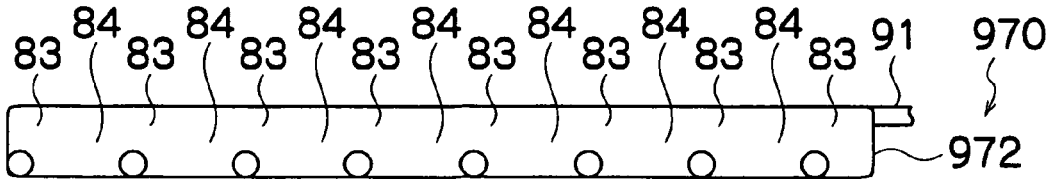
FIG. 12 is a plan diagram showing an example of an electrode having a uniform width, for the purpose of comparison with the pressure sensor according to the first embodiment.

The electrodes 721*a* and 722*a* of the pressure sensor 70*a* according to the first embodiment are formed in such a manner that the width of the coupling sections 84 corresponding to the positions between pressure chambers 52 is narrower than the width of the measurement correspondence sections 83 corresponding to the positions of the pressure chambers 52, as described above. This pressure sensor 70*a* according to the first embodiment is now compared with a pressure sensor 970 having an electrode 972 of uniform width as shown in FIG. 12.

Here, the pitch of the pressure chambers 52 arranged in two-dimensional configuration is 0.5 mm in both the longitudinal direction (sub-scanning direction) and the lateral direction (main scanning direction), and the size of each pressure chamber 52 is 0.3 mm in both the longitudinal and lateral directions. Consequently, since the pressure chambers 52 having the width of 0.3 mm are arranged at the pitch of 0.5 mm, then in the case of the electrode 972 having uniform width of the pressure sensor 970 shown in FIG. 12, some 40% (=(0.5−0.3)/0.5×100%) of the electrode forms a region that is not required for pressure measurement. If the number of pressure chambers 52 corresponding to one pressure sensor 970 is eight, then there are seven locations between the pressure chambers 52, and hence the electrostatic capacitance of the pressure sensor 970 having the electrode 972 of uniform width as shown in FIG. 12 becomes approximately 1.58 (=(40×7+60×8)/(60×8)) times the capacitance in a case where there are no coupling sections 84 at all. Therefore, the output voltage becomes approximately 0.63 times as large. On the other hand, taking the width of the coupling sections 84 to be approximately ⅓ of the width of the pressure chambers 52, the electrostatic capacitance of the pressure sensor 70*a* according to the first embodiment, which has coupling sections 84 of narrow width in the electrode 72*a*, as shown in FIG. 11, becomes approximately 1.19 (=(40×7×(⅓)+60×8)/(60×8)) times the capacitance in a case where there are no coupling sections 84 at all, and the output voltage becomes approximately 0.84 times as large. Hence, concerning the pressure sensor 70*a* according to the first embodiment as shown in FIG. 11, the output voltage increases by approximately 1.33 (=0.84/0.63) times with respect to the pressure sensor 970 having the electrode 972 of uniform width shown in FIG. 12, and this is equivalent to an improvement of 2.5 dB.

The case is described above in which the coupling sections 84 of both the positive electrode and the negative electrode of the pressure sensor 70 are formed to a narrower width than the width of the measurement correspondence sections 83, but it is also possible to make the coupling sections 84 of only one of the electrodes, either the positive electrode or the negative electrode, narrower than the width of the measurement correspondence sections 83.

Next, a pressure sensor 70*b* according to a second embodiment is described with reference to FIGS. 13A, 13B and 13C below.

Figure 13A:
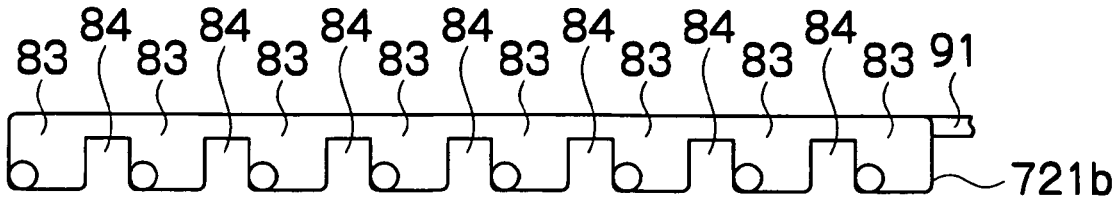
FIGS. 13A to 13C are plan diagrams showing a pressure sensor and electrodes according to a second embodiment of the invention.

FIG. 13A is a plan diagram showing a positive electrode 721*b* of the pressure sensor 70*b* according to the second embodiment. FIG. 13B is a plan diagram showing a negative electrode 722*b* of the pressure sensor 70*b* according to the second embodiment. FIG. 13C is a plan diagram of the pressure sensor 70*b* according to the second embodiment, which indicates the negative electrode 722*b* in FIG. 13B by means of dashed lines, as well as showing the positive electrode 721*b* in FIG. 13A by means of solid lines. In FIGS. 13A, 13B and 13C, the pressure measurement piezoelectric body which is sandwiched between the pair of electrodes 721*b* and 722*b* is taken to be provided commonly for all of the pressure chambers 52, and it is not shown in these drawings.

Figure 13B:
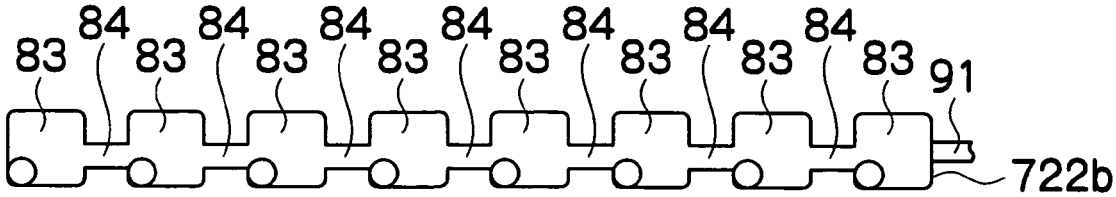
Figure 13C:
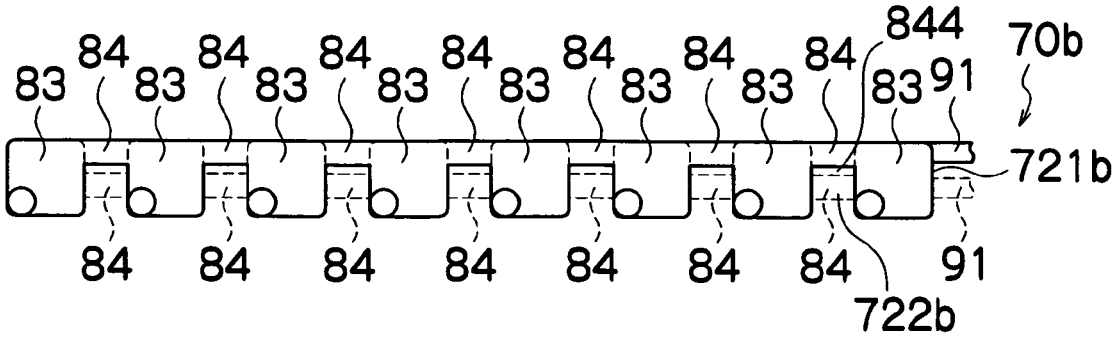

As shown in FIGS. 13A, 13B and 13C, the electrodes (positive electrode 721*b* and negative electrode 722*b*) of the pressure sensor 70*b* according to the second embodiment are formed in such a manner that the width of the coupling sections 84 corresponding to the positions between the pressure chambers 52 is narrower than the width of the measurement correspondence sections 83 corresponding to the positions of the pressure chambers 52.

Furthermore, as shown in FIG. 13C in particular, in the pressure sensor 70*b* according to the second embodiment, the coupling sections 84 of the positive electrode 721*b* and the coupling sections 84 of the negative electrode 722*b* are disposed at mutually different positions in terms of the horizontal direction (i.e., the direction perpendicular to the thickness direction), in such a manner that they do not coincide in position with each other in the vertical direction (i.e., the thickness direction).

As shown in FIG. 13C, when viewed in the vertical direction (thickness direction), desirably, gaps 844 are formed between the coupling sections 84 of the positive electrode 721*b* and the coupling sections 84 of the negative electrode 722*b*.

In the pressure sensor 70*b* according to the second embodiment, by disposing the coupling sections 84 of the positive electrode 721*b* and the coupling sections 84 of the negative electrode 722*b* in mutually different positions in the horizontal direction (the direction perpendicular to the thickness direction), in such a manner that the coupling sections 84 of the positive electrode 721*b* and the coupling sections 84 of the negative electrode 722*b* do not coincide in position with each other, then it is possible to reduce unwanted electrostatic capacitance, and hence to reduce the occurrence of unwanted signal components, in comparison with the pressure sensor 70*a* according to the first embodiment.

More specifically, the electrostatic capacitance of the coupling sections 84 of the electrodes 721*b* and 722*b*, which are not required for pressure measurement, is reduced or eliminated, and the overall electrostatic capacitance of the pressure sensor 70*b* becomes the same (1 time) as the capacitance when there are no coupling sections 84 at all, and the output voltage also becomes the same (1 time). When compared with the pressure sensor 970 in which the electrode 972 has the uniform width as shown in FIG. 12, the output voltage is improved by approximately 1.59 (=1/0.63) times, and this is equivalent to an improvement of 4 dB.

Next, a pressure sensor 70*c* according to a third embodiment is described with reference to FIGS. 14A, 14B and 14C below.

Figure 14A:
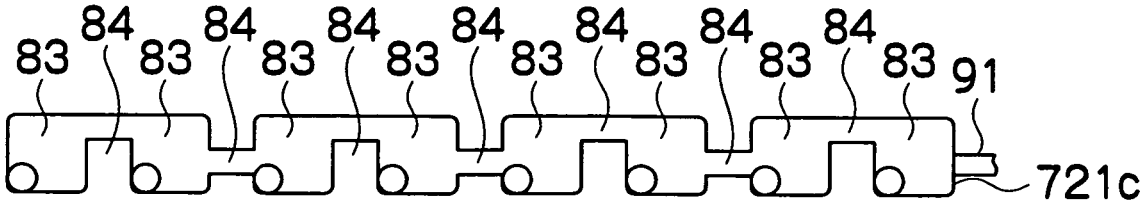
FIGS. 14A to 14C are plan diagrams showing a pressure sensor and electrodes according to a third embodiment of the invention.

FIG. 14A is a plan diagram showing a positive electrode 721*c* of the pressure sensor 70*c* according to the third embodiment. FIG. 14B is a plan diagram showing a negative electrode 722*c* of the pressure sensor 70*c* according to the third embodiment. FIG. 14C is a plan diagram of the pressure sensor 70*c* according to the third embodiment, which indicates the negative electrode 722*c* in FIG. 14B by means of dashed lines, and indicates the positive electrode 721*c* in FIG. 14A by means of solid lines. In FIGS. 14A, 14B and 14C, the pressure measurement piezoelectric body which is sandwiched between the pair of electrodes 721*c* and 722*c* is taken to be provided commonly for all of the pressure chambers 52, and it is not shown in these drawings.

Figure 14B:
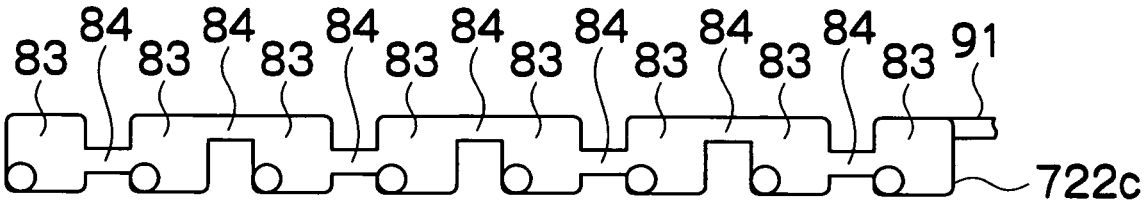
Figure 14C:
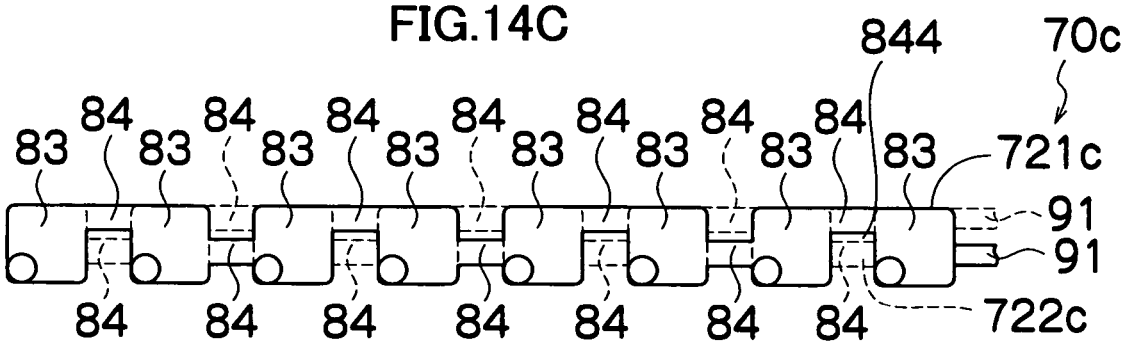

As shown in FIGS. 14A, 14B and 14C, the electrodes 721*c* and 722*c* of the pressure sensor 70*c* according to the third embodiment are formed in such a manner that the width of the coupling sections 84 corresponding to the positions between the pressure chambers 52 is narrower than the width of the measurement correspondence sections 83 corresponding to the positions of the pressure chambers 52.

Furthermore, in the pressure sensor 70*c* according to the third embodiment, the coupling sections 84 of the positive electrode 721*c* and the coupling sections 84 of the negative electrode 722*c* are disposed at mutually different positions in the horizontal direction (the direction perpendicular to the thickness direction), in such a manner that they do not coincide in position with each other in the vertical direction (namely, the thickness direction).

Moreover, in the pressure sensor 70*c* according to the third embodiment, the coupling sections 84 in the same electrode are disposed in alternating positions in the horizontal direction (the direction perpendicular to the thickness direction).

More specifically, if the pressure sensor 70*c* is disposed in the horizontal direction (the direction perpendicular to the thickness direction), as shown in FIGS. 14A, 14B and 14C, then the plurality of coupling sections 84 are positioned alternately in upper and lower positions, as shown in FIG. 14C, in each of the electrodes 721*c* and 722*c*. In practice, the plurality of coupling sections 84 are located in alternating positions in a staggered fashion in the horizontal direction (the direction perpendicular to the thickness direction).

More specifically, in the positive electrode 721*c*, the positions of the plurality of coupling sections 84 which connect together the plurality of measurement correspondence sections 83 aligned in the lengthwise direction of the electrode 721*c* change in an alternating fashion, between upper, lower, upper, lower, and so on, in FIG. 14C (or between right, left, right, left, and so on, in the breadthways direction of the electrodes 721*c*). In the negative electrode 722*c* also, the positions of the plurality of coupling sections 84 change in an alternating fashion, between lower, upper, lower, upper and so on, in FIG. 14C, (or left, right, left, right, and so on, in the breadthways direction of the electrode 722*c*), in such a manner that they lie in opposite positions to the coupling sections 84 of the positive electrode 721*c*, in terms of the breadthways direction.

As shown in FIG. 14C, when viewed in the vertical direction (thickness direction), desirably, gaps 844 are formed between the coupling sections 84 of the positive electrode 721*b* and the coupling sections 84 of the negative electrode 722*b*.

In the pressure sensor 70*c* according to the third embodiment, by preventing the coupling sections 84 of the positive electrode 721*c* from coinciding in position with the coupling sections 84 of the negative electrode 722*c*, it is possible to reduce unwanted electrostatic capacitance, as well as to reduce the occurrence of unwanted signal components, in comparison with the pressure sensor 70*a* of the first embodiment.

Moreover, by disposing the coupling sections 84 in alternating positions in the same electrodes, then all of the coupling sections 84 may be affected uniformly by electrical cross-talk and electromagnetic wave noise from the environment, in both of the electrodes 721*c* and 722*c*, and therefore, the cross-talk and noise can be cancelled out accurately by finding the difference between the pressure measurement signal outputted from the positive electrode 721*c* and the pressure measurement signal outputted from the negative electrode 722*c*, as described later.

Furthermore, even if a shearing distortion occurs in the plane direction, due to thermal expansion or external force, the effects produced in the coupling sections 84 can be cancelled out to a large extent. This is because, when a shearing distortion is applied within the plane, it is cancelled out mutually between the coupling sections 84 positioned relatively on the upper side and the coupling sections 84 positioned relatively on the lower side. In particular, when the number of coupling sections 84 is even in one electrode, then provided that the shearing distortion is uniform within the plane, the effects produced in the coupling sections 84 become zero.

Next, a pressure sensor 70*d* according to a fourth embodiment is described with reference to FIGS. 15A, 15B and 15C below.

Figure 15A:
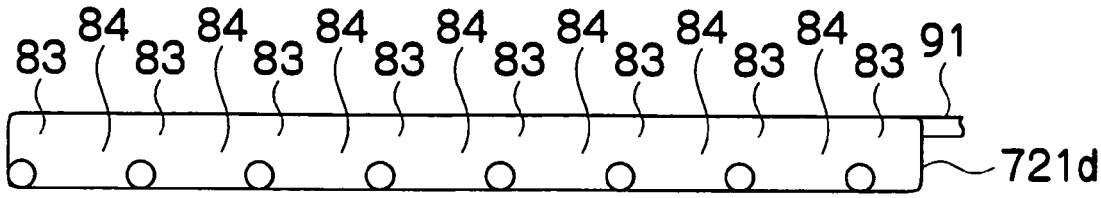
FIGS. 15A to 15C are plan diagrams showing a pressure sensor and electrodes according to a fourth embodiment of the invention.

FIG. 15A is a plan diagram showing a positive electrode 721*d* of the pressure sensor 70*d* according to the fourth embodiment. FIG. 15B is a plan diagram showing a negative electrode 722*d* of the pressure sensor 70*d* according to the fourth embodiment. FIG. 15C is a plan diagram of the pressure sensor 70*d* according to the fourth embodiment, which indicates the negative electrode 722*d* in FIG. 15B by means of dashed lines, and indicates the positive electrode 721*d* in FIG. 15A by means of solid lines.

Figure 15B:
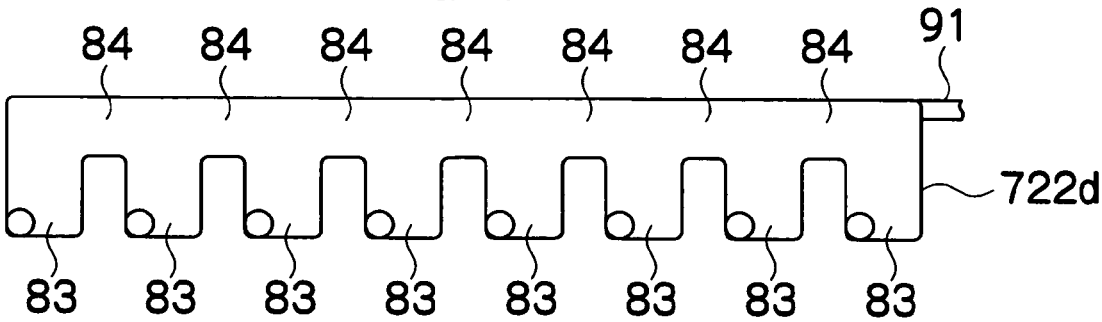
Figure 15C:
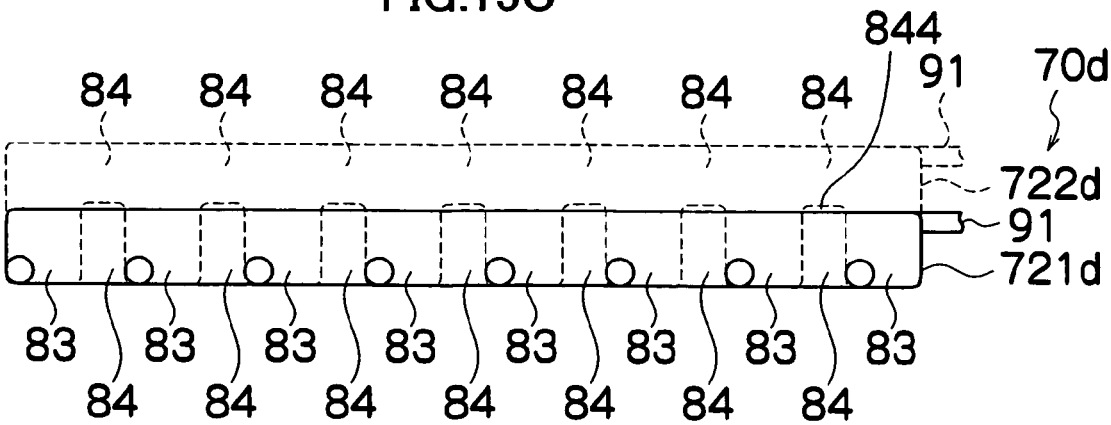

As shown in FIGS. 15A, 15B and 15C, in the pressure sensor 70*d* according to the fourth embodiment, the coupling sections 84 of the positive electrode 721*d* and the coupling sections 84 of the negative electrode 722*d* are disposed at mutually different positions in the horizontal direction (namely, the direction perpendicular to the thickness direction), in such a manner that they do not coincide in position with each other in the vertical direction (namely, the thickness direction).

The width of the pressure sensor 70*d* according to the fourth embodiment is substantially uniform.

More specifically, according to the pressure sensor 70*d* of the fourth embodiment, the electrostatic capacitance of the coupling sections 84 of the electrodes 721*d* and 722*d*, which are not required for pressure measurement, is reduced or eliminated, and the overall electrostatic capacitance of the pressure sensor 70*d* becomes the same (1 time) as the capacitance when there are no coupling sections 84 at all, and the output voltage also becomes the same (1 time) as the output voltage when there are no coupling sections 84 at all.

As shown in FIG. 15C, when viewed in the vertical direction (thickness direction), desirably, gaps 844 are formed between the positive electrode 721*d* and the negative electrode 722*d*.

Next, a pressure sensor 70*e* according to a fifth embodiment is described with reference to FIGS. 16A, 16B and 16C below.

Figure 16A:
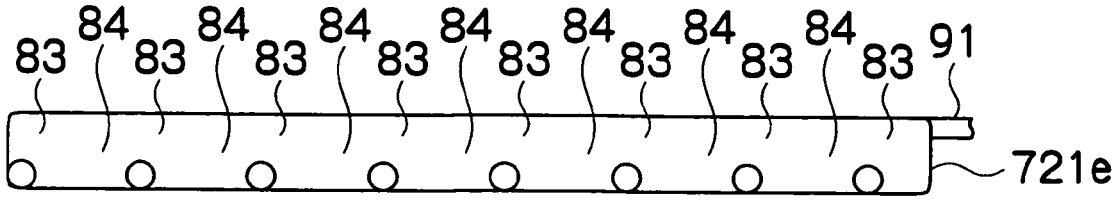
FIGS. 16A to 16C are plan diagrams showing a pressure sensor and electrodes according to a fifth embodiment of the invention.

FIG. 16A is a plan diagram showing a positive electrode 721*e* of the pressure sensor 70*e* according to the fifth embodiment. FIG. 16B is a plan diagram showing a negative electrode 722*e* of the pressure sensor 70*e* according to the fifth embodiment. FIG. 16C is a plan diagram of the pressure sensor 70*e* according to the fifth embodiment, which indicates the negative electrode 722*e* in FIG. 16B by means of dashed lines, and indicates the positive electrode 721*e* in FIG. 16A by means of solid lines.

Figure 16B:
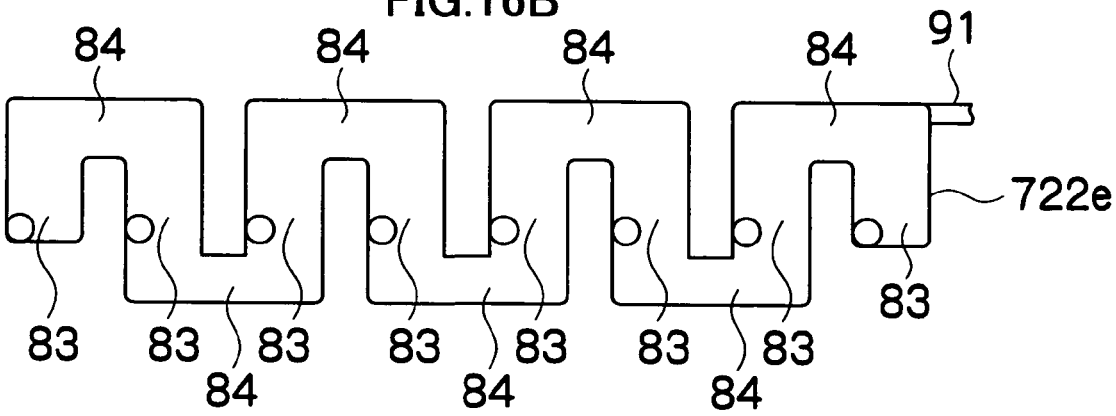
Figure 16C:
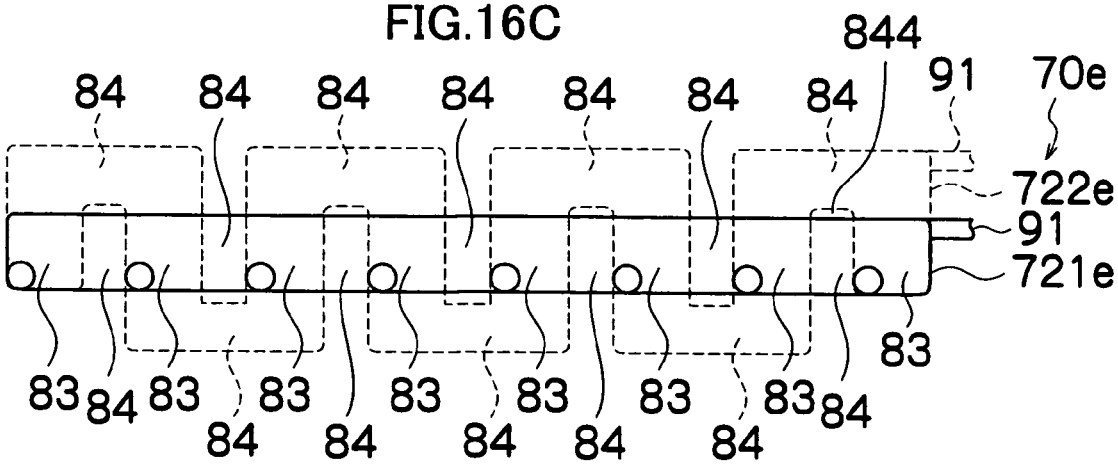

As shown in FIGS. 16A, 16B and 16C, in the pressure sensor 70*e* according to the fifth embodiment, similarly to the pressure sensor 70*d* according to the fourth embodiment, the coupling sections 84 of the positive electrode 721*e* and the coupling sections 84 of the negative electrode 722*e* are disposed at mutually different positions in the horizontal direction (the direction perpendicular to the thickness direction), in such a manner that they do not coincide in position with each other in the vertical direction (namely, the thickness direction).

Moreover, in the pressure sensor 70*e* according to the fifth embodiment, the coupling sections 84 in the negative electrode 722*e* are disposed in alternating positions in the horizontal direction (the direction perpendicular to the thickness direction). More specifically, as shown in FIGS. 16A, 16B and 16C, if the pressure sensor 70*e* is disposed in the horizontal direction, then the plurality of coupling sections 84 are disposed alternately in upper and lower positions, in the negative electrode 722*e*.

The width of the pressure sensor 70*e* according to the fifth embodiment is substantially uniform.

Moreover, as shown in FIG. 16C, when viewed in the vertical direction (thickness direction), desirably, gaps 844 are formed between the coupling sections 84 of the positive electrode 721*e* and the coupling sections 84 of the negative electrode 722*e*.

Composition of Image Forming Apparatus

Figure 17:
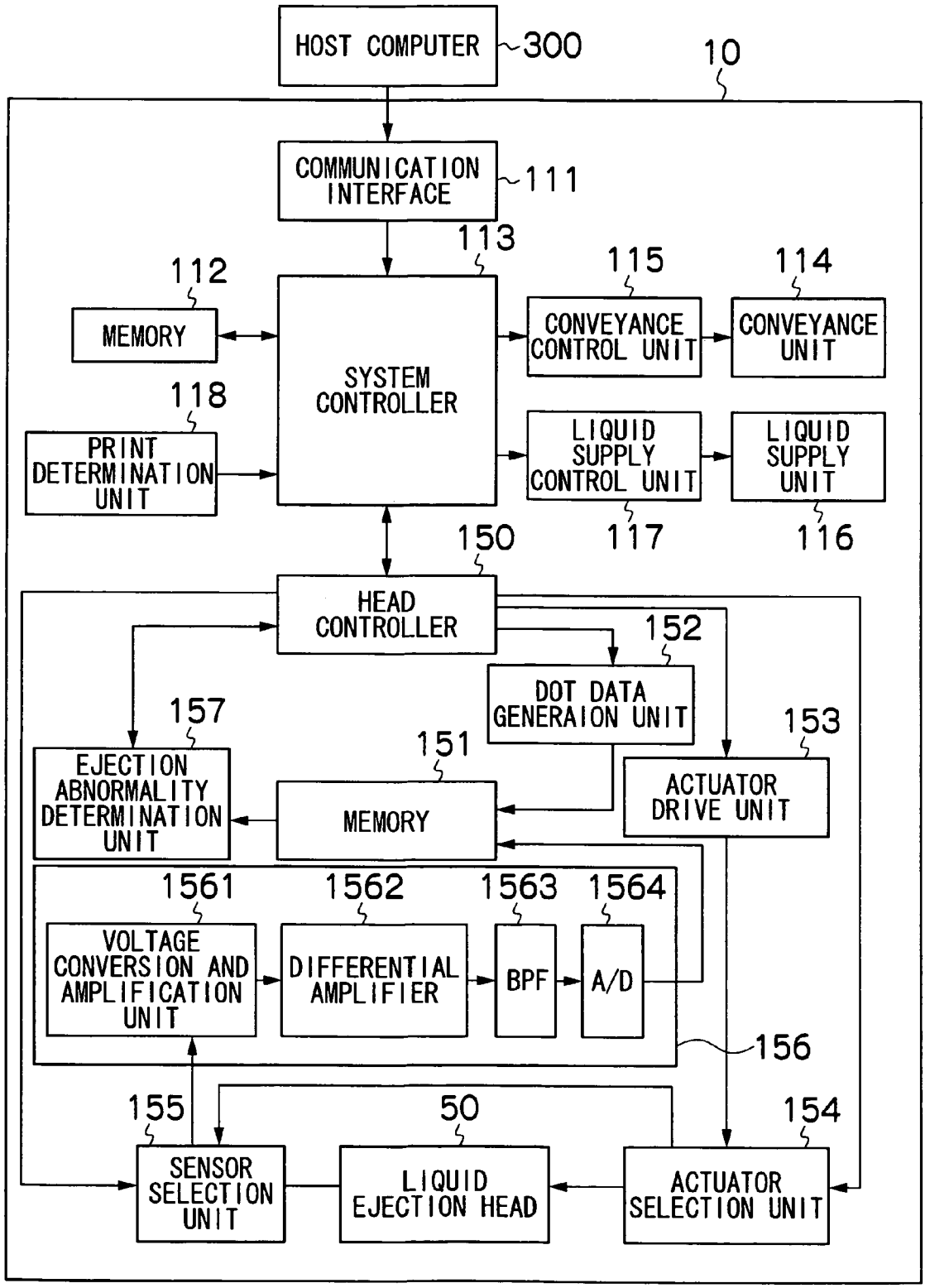
FIG. 17 is a block diagram showing the general composition of an example of an image forming apparatus.

FIG. 17 is a block diagram showing an embodiment of the general composition of an image forming apparatus 10 comprising the liquid ejection head 50 shown in FIG. 1.

The image forming apparatus 10 shown in FIG. 17 mainly comprises: a communication interface 111; memories 112 and 151; a system controller 113; a conveyance unit 114; a conveyance control unit 115; a liquid supply unit 116; a liquid supply control unit 117; a print determination unit 118; a head controller 150; a dot data generation unit 152; an actuator drive unit 153; an actuator selection unit 154; a sensor selection unit 155; a pressure measurement signal processing unit 156; and an ejection abnormality determination unit 157.

The communication interface 111 is an image data input device for receiving image data transmitted by a host computer 300. For the communication interface 111, a wired interface, such as a USB, IEEE 1394, Ethernet, or the like, or wireless interface can be used.

Image data sent from the host computer 300 is read into the image forming apparatus 10 via the communication interface 111, and is stored temporarily in the memory 112 for system control.

There are no particular limitations on the image data input mode, and the image data input mode is not limited in particular to the case that image data is inputted by means of communications with the host computer 300. For example, it is also possible to input image data to the image forming apparatus 10 by reading in image data from a removable media, such as a memory card or optical disk.

The system controller 113 is constituted by a central processing unit (CPU) and peripheral circuits thereof, and the like, and it forms a main control device which controls the whole of the image forming apparatus 10 in accordance with a prescribed program. In other words, the system controller 112 controls the sections, such as the communication interface 111, the system control member 112, the conveyance control unit 115, the liquid supply control unit 117, the print determination unit 118, and the head controller 150.

The conveyance unit 114 conveys the recording medium, such as paper, along a prescribed conveyance path. For example, it comprises a conveyance belt on which the recording medium is mounted by suction, and a conveyance roller and conveyance motor which drive the conveyance belt.

The conveyance control unit 115 is a driver (drive circuit) which drives the conveyance unit 114 in accordance with instructions from the system controller 113.

The conveyance unit 114 is controlled by the conveyance control unit 115, and it causes the recording medium and the liquid ejection head 50 to move relatively with respect to each other, in the direction of conveyance of the recording medium (the sub-scanning direction).

The liquid supply unit 116 supplies ink to the liquid ejection head 50. The liquid supply unit 116 comprises: tubing channels which lead to the liquid ejection head 50 from an ink storage section (not shown), such as an ink cartridge, installed detachably in the image forming apparatus 10; a pump; and the like.

The liquid supply control unit 117 controls the liquid supply unit 116 in accordance with instructions from the system controller 113, thereby supplying ink from the ink storage section, such as the ink cartridge, to the liquid ejection head 50.

The print determination unit 118 comprises an image sensor for capturing an image of the ejection results of the liquid ejection head 50, and it functions as a device for checking for ejection defects, such as displacement of the landing position, on the basis of the image read out by the image sensor.

The head controller 150 controls image formation by the liquid ejection head 50, and ejection abnormality determination by the liquid ejection head 50, in accordance with instructions from the system controller 113.

The dot data generation unit 152, generates dot data from the image data, in accordance with instructions from the head controller 150. The image data is inputted to the image forming apparatus 10, by means of the communication interface 111, or the like, and is stored in the memory 112. The dot data is principally data that indicates the arrangement of the dots. If the dot size is variable, then the dot data also indicates the dot size, as well as the dot arrangement. The dot data thus generated is stored in the head control memory 151.

The actuator drive unit 153 generates prescribed drive signals which are supplied to the actuators 60 of the liquid ejection head 50, in accordance with instructions from the head controller 150. The drive signals thus generated are outputted to the actuator selection unit 154.

The head controller 150 determines the actuator(s) 60 to which a drive signal is to be supplied, from all of the actuators 60 arranged two-dimensionally inside the liquid ejection head 50, on the basis of the dot data generated by the dot data generation unit 152, and it generates an actuator selection signal indicating the actuator(s) 60 to which the drive signal is to be applied. The actuator selection signal thus generated is outputted to the actuator selection unit 154. The actuator selection signal is supplied to the actuator selection unit 154, in synchronization with the drive signal generated by the actuator drive unit 153.

The actuator selection unit 154 comprises a switching circuit and a multiplexer logic circuit. The actuator selection unit 154 selects an actuator(s) 60 and supplies the drive signal generated by the actuator drive unit 153 to same, on the basis of the actuator selection signal outputted from the head controller 150.

The actuator(s) 60 of the liquid ejection head 50 to which the drive signal is supplied from the actuator selection unit 154 generates a pressure and causes ink to be ejected from the nozzle 51 by changing the volume of the corresponding pressure chamber 52.

In parallel with the ejection of ink toward the recording medium by the liquid ejection head 50, the head controller 150 identifies a pressure sensor 70 to carry out pressure measurement in order to determine ejection abnormalities, on the basis of the dot data generated by the dot data generation unit 152, and thereby it creates a sensor selection signal indicating the pressure sensor 70 thus identified. The sensor selection signal thus generated is outputted to the sensor selection unit 155.

The sensor selection unit 155 comprises a switching circuit and a multiplexer logic circuit. The sensor selection unit 155 selects a pressure sensor 70 on the basis of the sensor selection signal outputted from the head controller 150.

The pressure sensors 70 inside the liquid ejection head 50 measure the internal pressure of the corresponding pressure chambers 52 and output pressure measurement signals accordingly. More specifically, each pressure sensor 70 of the liquid ejection head 50 has a pair of electrodes, namely, a positive electrode and a negative electrode, and hence a positive electrode pressure measurement signal and a negative electrode pressure measurement signal are outputted from each of the pressure sensors 70.

The sensor selection unit 155 outputs the pressure measurement signal received from the selection pressure sensor 70, to the pressure measurement signal processing unit 156.

The pressure measurement signal processing unit 156 mainly comprises: a voltage conversion and amplification circuit 1561; a differential circuit 1562; a band-pass filter (BPF) 1563; and an A/D converter 1564.

The voltage conversion and amplification circuit 1561 performs prescribed voltage conversion and amplification with respect to the pressure measurement signal outputted from the positive electrode of the pressure sensor 70 and the pressure measurement signal outputted from the negative electrode of same.

The differential circuit 1562 finds the difference between the pressure measurement signal outputted from the positive electrode of the pressure sensor 70 and the pressure measurement signal outputted from the negative electrode of same (subtraction is done therebetween). In the example shown in FIG. 17, in actual practice, the difference is found between the pressure measurement signals after prescribed voltage conversion and amplification processing by the voltage conversion and amplification circuit 1561.

The pressure measurement signal after difference processing outputted from the differential circuit 1562 is explained below.

By finding the difference between the pressure measurement signal outputted from the positive electrode of the pressure sensor 70 and the pressure measurement signal outputted from the negative electrode of same, by means of the differential circuit 1562, the electrical cross-talk and radio wave noise received by the pressure sensor 70 is cancelled out.

Figure 18A:
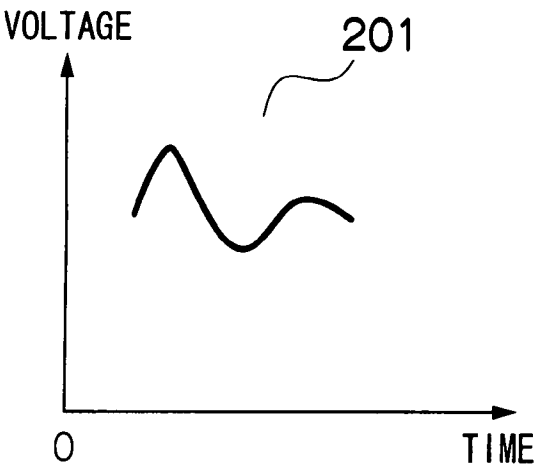
FIGS. 18A to 18C are illustrative diagrams for describing the step of finding the difference between a signal output from the positive electrode of a pressure sensor and a signal output from the negative electrode of same.
Figure 18B:
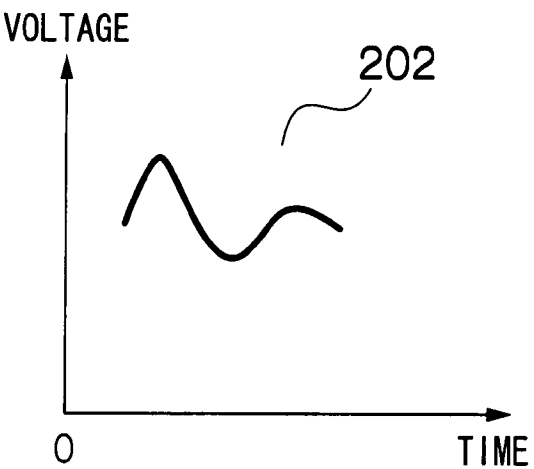
Figure 18C:
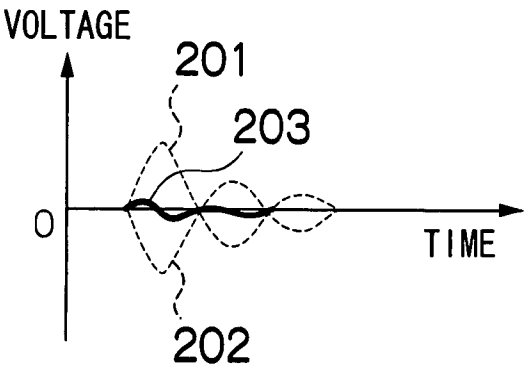

FIG. 18A shows a waveform 201 of one example of a pressure measurement signal outputted from the positive electrode of the pressure sensor 70, and FIG. 18B shows a waveform 202 of one example of a pressure measurement signal outputted from the negative electrode of the pressure sensor 70. These waveforms 201 and 202 include unwanted signal components. FIG. 18C shows a waveform 203 of one example of a pressure measurement signal in which the unwanted waveform components have been cancelled out by means of the differential circuit 1562.

The signal outputted from the differential circuit 1562 is passed through the band-pass filter (BPF) 1563, thereby removing unwanted waveband components including low-frequency noise components, and it is then converted from analog to digital by the A/D converter 1564.

The pressure measurement signal processed by the pressure measurement signal processing unit 156 in this way is then stored in the head control memory 151, as pressure measurement data.

The ejection abnormality determination unit 157 determines whether or not ejection has been performed normally from the nozzle 51 corresponding to the pressure chamber 52 which is the object of pressure measurement, on the basis of the pressure measurement data stored in the memory 151. The result of this determination by the ejection abnormality determination unit 157 is transmitted to the system controller 113.

Furthermore, desirably, the measurement timings are staggered, in such a manner that no cross-talk is produced and also in such a manner that pressure measurement is not performed simultaneously in mutually adjacent pressure sensors 70.

More specifically, for example, pressure measurement is carried out in each row of pressure sensors 70, by staggering the drive timings of the actuators 60 respectively, in each row of pressure sensors 70, by means of the actuator selection unit 154.

Furthermore, since each of the pressure sensors 70 is provided commonly for a plurality of pressure chambers 52, and the wires 91 and electrode pads 92 are also provided commonly for a plurality of pressure chambers 52, as shown in FIG. 10, then generally, the measurement timings are staggered in such a manner that pressure measurement is not performed simultaneously in the plurality of pressure chambers 52 that correspond to any one pressure sensor 70.

In other words, for example, pressure measurement is carried out for each pressure chamber 52, by staggering the drive timings of the actuators 60 with respect to each pressure chamber 52, by means of the actuator selection unit 154.

Here, "staggering the measurement timings" is not based on the precondition that a special ejection is performed for the purpose of pressure measurement. Even in the case of ejection based on normal image data, since the nozzles 51 are either in a state of ejecting ink or a state of not ejecting ink, depending on the image data, then it is possible to measure the pressure during ejection, on the basis of this normal image data.

More specifically, pressure measurement is carried out at the timing at which ejection is to be performed from only one nozzle 51 of the plurality of nozzles 51 in a group corresponding to any one pressure sensor 70 (in other words, at the timing at which one actuator 60 is driven only at one pressure chamber 52 of the plurality of pressure chambers 52 is belonging to the same group).

There are various different possible connection modes for the liquid ejection head 50, sensor selection unit 155, voltage conversion and amplification circuit 1561, differential circuit 1562, BPF 1563, and A/D converter 1564. In other words, there are various possible connection modes for the differential circuit 1562.

In the connection mode shown as one example in FIG. 17 (the first connection mode), the elements are connected in the following order: liquid ejection head 50→sensor selection unit 155→voltage conversion and amplification circuit 1561→differential circuit 1562→BPF 1563→A/D converter 1564. In this way, since the voltage conversion and amplification circuit 1561 is provided after the sensor selection unit 155, then compared to a case where the voltage conversion and amplification circuit 1561 is provided before the sensor selection unit 155, the number of circuits (number of components) can be reduced, which is desirable in terms of being able to reduce manufacturing costs. This first connection mode is a composition used in cases where the pressure sensor 70 has good performance (a high signal output), and there is relative surplus margin in the S/N ratio, or cases where costs are prioritized over performance.

The second connection mode is one in which the elements are connected in the following order: liquid ejection head 50→sensor selection unit 155→differential circuit 1562→voltage conversion and amplification circuit 1561→BPF 1563→A/D converter 1564. If the voltage conversion and amplification circuit 1561 is provided after the differential circuit 1562, which is provided after the sensor selection unit 155, then it is possible to reduce the voltage conversion and amplification circuit 1561 further, compared to the first connection mode described above. This second connection mode is used in cases where cost is prioritized to an even greater extent than in the first connection mode.

The third connection mode is one in which the elements are connected in the following order: liquid ejection head 50→voltage conversion and amplification circuit 1561→sensor selection unit 155→differential circuit 1562→BPF 1563→A/D converter 1564. This third connection mode is desirable in that, since the voltage conversion and amplification circuit 1561 can be positioned in the vicinity of the pressure sensor 70, then it is possible to amplify the pressure measurement signal before the inclusion of noise in the wiring, and hence the reliability of the pressure measurement signal can be improved.

The fourth connection mode is one in which the differential circuit 1562 is omitted and the elements are connected in the following order: liquid ejection head 50→sensor selection unit 155→BPF 1563→A/D converter 1564. In the fourth connection mode, provided that the signal outputted from the pressure sensor 70 is sufficiently high, the voltage amplification and conversion circuit 1561 is also omitted, and the output signal from the sensor selection unit 155 is inputted directly to the BPF 1563. This fourth connection mode is a composition used in cases where the pressure sensor has good performance (a high signal output), and there is relative surplus margin in the S/N ratio, or cases where costs are prioritized to a maximum over performance. If the S/N ratio is sufficiently good, then the differential circuit 1562 is omitted and only one of the pressure measurement signal from the positive electrode of the pressure sensor 70 and the pressure measurement signal from the negative electrode is used. A pressure measurement signal outputted from an electrode in the vicinity of the pressure chamber 52 has a higher signal output than a pressure measurement signal outputted from an electrode that is distant from the pressure chamber 52. On the other hand, the signal outputted from an electrode distant from the pressure chamber 52 is less liable to the effects of electrical noise produced by the actuator 60. The determination on whether to use the pressure measurement signal outputted from one electrode or the other is generally made in accordance with the magnitude of the signal output (absolute value), and the degree to which the pressure sensor 70 is shielded from the noise of the actuators 60.

In FIG. 17, the actuator drive unit 153, the actuator selection unit 154, the sensor selection unit 155 and the pressure measurement signal circuit 156 are depicted as being outside the liquid ejection head 50, but it is also possible to provide all or a portion of these elements inside the liquid ejection head 50.

Furthermore, a case has been described in which the nozzles 51 and pressure chambers 52 of the liquid ejection head 50 are arranged in a two-dimensional matrix configuration, as shown in FIG. 1, but the present invention is not limited in particular to cases of this kind. For example, it is also possible to apply the present invention to a case where the nozzles 51 and pressure chambers 52 are arranged one-dimensionally.

Furthermore, a case has been described in which the liquid ejection head 50 is a piezo type of head, but the present invention is not limited in particular to cases of this kind. For example, it goes without saying that the present invention may also be applied to a thermal jet liquid ejection head which generates a bubble by heating the ink by means of a heater, or other heating element, and propels an ink droplet by means of the pressure thus generated.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a pressure sensor, located in the liquid ejection head, which is provided commonly with respect to a plurality of pressure chambers, the pressure sensor comprising:

a piezoelectric body; and a first electrode and a second electrode which are disposed on either side of the piezoelectric body in a thickness direction, wherein at least one of the first electrode and the second electrode is formed so as to have a narrower width in coupling sections corresponding to positions between the pressure chambers, than a width of sections corresponding to the pressure chambers, and wherein the pressure sensor measures internal pressure of each of the plurality of pressure chambers and outputs a voltage corresponding to the internal pressure measured in the plurality of pressure chambers.

2. The liquid ejection head as defined in claim 1, wherein the coupling sections of the first electrode and the coupling sections of the second electrode are disposed at mutually different positions in a direction perpendicular to the thickness direction of the piezoelectric body, so as not to coincide in position with each other in the thickness direction of the piezoelectric body.

3. The liquid ejection head as defined in claim 2, wherein, in at least one of the first electrode and the second electrode, the coupling sections are disposed alternately in different positions in the direction perpendicular to the thickness direction of the piezoelectric body.

4. A liquid ejection apparatus, comprising:

the liquid ejection head as defined in claim 1; and a device which finds a difference between an output signal of the first electrode and an output signal of the second electrode.

5. A liquid ejection head having a pressure sensor, located in the liquid ejection head, which is provided commonly with respect to a plurality of pressure chambers, the pressure sensor comprising:

a piezoelectric body; and a first electrode and a second electrode which are disposed on either side of the piezoelectric body in a thickness direction, each of the first electrode and the second electrode having sections corresponding to the pressure chambers and coupling sections corresponding to positions between the pressure chambers, wherein at least one of the first electrode and the second electrode is formed so as to have a narrower width in coupling sections corresponding to positions between the pressure chambers, than a width of sections corresponding to the pressure chambers, wherein the coupling sections of the first electrode and the coupling sections of the second electrode are disposed at mutually different positions in a direction perpendicular to the thickness direction of the piezoelectric body, so as not to coincide in position with each other in the thickness direction of the piezoelectric body, and wherein the pressure sensor measures internal pressure of each of the plurality of pressure chambers and outputs a voltage corresponding to the internal pressure measured in the plurality of pressure chambers.

6. The liquid ejection head as defined in claim 5, wherein, in at least one of the first electrode and the second electrode, the coupling sections are disposed alternately in different positions in the direction perpendicular to the thickness direction of the piezoelectric body.

7. A liquid ejection apparatus, comprising:

the liquid ejection head as defined in claim 5; and a device which finds a difference between an output signal of the first electrode and an output signal of the second electrode.

8. A liquid ejection head, comprising:

a plurality of pressure chambers connected to ejection ports which eject liquid; and a pressure sensor which is provided commonly with respect to a plurality of pressure measurement objects, the pressure sensor comprising:

a piezoelectric body; and a first electrode and a second electrode which are disposed on either side of the piezoelectric body in a thickness direction, wherein at least one of the first electrode and the second electrode is formed so as to have a narrower width in coupling sections corresponding to positions between the pressure measurement objects, than a width of sections corresponding to the pressure measurement objects, and where the pressure sensor measures internal pressure of the pressure chambers, by taking the pressure chambers as the pressure measurement objects, and outputs a voltage corresponding to an internal pressure in the plurality of pressure chambers.

9. An image forming apparatus, comprising the liquid ejection head as defined in claim 8, wherein an image is formed on a prescribed recording medium by ejecting ink from the liquid ejection head towards the recording medium.

10. The image forming apparatus as defined in claim 9, further comprising a device for finding a difference between an output signal of the first electrode and an output signal of the second electrode.

11. A liquid ejection head, comprising:

a plurality of pressure chambers connected to ejection ports which eject liquid; and pressure sensor which is provided commonly with respect to a plurality of pressure measurement objects, the pressure sensor comprising:

a piezoelectric body; and a first electrode and a second electrode which are disposed on either side of the piezoelectric body in a thickness direction, each of the first electrode and the second electrode having sections corresponding to the pressure measurement objects and coupling sections corresponding to positions between the pressure measurement objects, wherein at least one of the first electrode and the second electrode is formed so as to have a narrower width in coupling sections corresponding to positions between the pressure measurement objects, than a width of sections corresponding to the pressure measurement objects, and wherein the coupling sections of the first electrode and the coupling sections of the second electrode are disposed at mutually different positions in a direction perpendicular to the thickness direction of the piezoelectric body, so as not to coincide in position with each other in the thickness direction of the piezoelectric body, where the pressure sensor measures internal pressure of the pressure chambers, by taking the pressure chambers as the pressure measurement objects, and outputs a voltage corresponding to an internal pressure in the plurality of pressure chambers.

12. An image forming apparatus, comprising the liquid ejection head as defined in claim 11, wherein an image is formed on a prescribed recording medium by ejecting ink from the liquid ejection head towards the recording medium.

13. The image forming apparatus as defined in claim 12, further comprising a device for finding a difference between an output signal of the first electrode and an output signal of the second electrode.

* * * * *